US010266353B2

(12) United States Patent
Hanamoto

(10) Patent No.: US 10,266,353 B2
(45) Date of Patent: Apr. 23, 2019

(54) DOCUMENT SHEET TRANSPORTATION DEVICE AND IMAGE FORMING APPARATUS PROVIDED THEREWITH

(71) Applicant: KYOCERA Document Solutions Inc., Osaka-shi (JP)

(72) Inventor: Katsuhiko Hanamoto, Osaka (JP)

(73) Assignee: KYOCERA Document Solutions, Inc., Osaka-shi, Osaka (JP)

( * ) Notice: Subject to any disclaimer, the term of this patent is extended or adjusted under 35 U.S.C. 154(b) by 0 days.

(21) Appl. No.: 15/917,959

(22) Filed: Mar. 12, 2018

(65) Prior Publication Data

US 2018/0257888 A1 Sep. 13, 2018

(30) Foreign Application Priority Data

Mar. 13, 2017 (JP) ..... 2017-047201

(51) Int. Cl.
*B65H 3/06* (2006.01)
*B65H 9/06* (2006.01)
(Continued)

(52) U.S. Cl.
CPC ..... *B65H 3/0684* (2013.01); *B65H 3/06* (2013.01); *B65H 3/34* (2013.01); *B65H 3/5207* (2013.01); *B65H 9/06* (2013.01); *B65H 2404/651* (2013.01); *B65H 2404/722* (2013.01); *B65H 2404/725* (2013.01); *B65H 2801/39* (2013.01)

(58) Field of Classification Search
CPC ..... B65H 3/00; B65H 3/0684; B65H 3/46; B65H 3/52; B65H 3/5207; B65H 3/5215; B65H 3/66; B65H 9/00; B65H 9/004; B65H 9/06; B65H 2404/63; B65H 2404/65; B65H 2404/651; B65H 2601/11; B65H 2601/255
See application file for complete search history.

(56) References Cited

U.S. PATENT DOCUMENTS 8,970,855 B2 * 3/2015 Muraoka ..... B65H 3/0669 358/1.12
2010/0133741 A1 * 6/2010 Sato ..... B65H 3/0684 271/114

(Continued)

FOREIGN PATENT DOCUMENTS

JP 2012-153522 8/2012

*Primary Examiner* — Prasad V Gokhale
(74) *Attorney, Agent, or Firm* — Gerald E. Hespos; Michael J. Porco; Matthew T. Hespos

(57) ABSTRACT

A document sheet transportation device includes a feeding portion which feeds a document sheet from a document sheet placement portion toward a document sheet transportation path. The feeding portion includes a holder, a feeding member, a supporting body supported by the holder, a rotatable stopper member having a contact end portion allowed to contact a front end of a document sheet, and a biasing member which applies a biasing force to the stopper member. The stopper member is allowed to change a position among a first position in which the contact end portion contacts the front end of the document sheet, a second position which allows feeding of the document sheet by the feeding member, and a third position which is rotated in the first rotating direction from the second position. The biasing member applies the biasing force to the stopper member in a reverse second rotating direction.

4 Claims, 19 Drawing Sheets

(51) Int. Cl.
*B65H 3/52* (2006.01)
*B65H 3/34* (2006.01)

(56) References Cited

U.S. PATENT DOCUMENTS

| | | | | |
|---|---|---|---|---|
| 2012/0193863 | A1* | 8/2012 | Harada | B65H 3/0684 271/110 |
| 2012/0193869 | A1* | 8/2012 | Hanamoto | B65H 3/0684 271/225 |
| 2016/0167902 | A1* | 6/2016 | Cheng | B65H 3/5207 271/121 |
| 2017/0297838 | A1* | 10/2017 | Hanamoto | B65H 3/0607 |

* cited by examiner

DOCUMENT SHEET TRANSPORTATION DEVICE AND IMAGE FORMING APPARATUS PROVIDED THEREWITH

INCORPORATION BY REFERENCE

The present application claims priority to Japanese Patent Application No. 2017-47201 filed on Mar. 13, 2017, the entire contents of which are incorporated by reference herein.

BACKGROUND

The present disclosure relates to a document sheet transportation device which transports a document sheet toward a predetermined document reading position, and an image forming apparatus provided therewith.

In an image forming apparatus such as a copy machine, a document sheet transportation device which automatically transports a document sheet to be read toward a predetermined document sheet reading position is attached. The document sheet transportation device is provided with a document sheet placement portion on which a document sheet is placed, a document sheet transportation path provided to extend from the document sheet placement portion, and a feeding portion which feeds the document sheet toward the document sheet transportation path. In a document sheet transportation device of this kind, the feeding portion includes a pickup roller which sends out document sheets placed in the document sheet placement portion to the document sheet transportation path one by one, a paper feeding roller which feeds the document sheet sent out by the pickup roller further to a downstream side of the document sheet transportation path, and a stopper mechanism.

The stopper mechanism, which is a mechanism arranged between the pickup roller and the paper feeding roller, is formed with a stopper piece rotatably supported by a supporting body. The stopper piece is allowed to change a position among a regulating position in which the stopper piece is in contact with a front end of a document sheet to regulate feeding by the paper feeding roller, a paper feeding allowing position, and a rotating position. During a feeding operation when the feeding portion feeds a document sheet, the stopper piece assumes the paper feeding allowing position in which the stopper piece is separated from the front end of the document sheet so as not to prevent the feeding operation of the feeding portion. Additionally, when the jam of the document sheet occurs in the feeding portion, the stopper piece rotates from the paper feeding allowing position to assume the rotating position in conjunction with movement of drawing-out of the document sheet from the feeding portion. This suppresses the document sheet from being caught by the stopper piece, thereby suppressing the document sheet from being damaged.

SUMMARY

A document sheet transportation device according to one aspect of the present disclosure includes a document sheet placement portion on which a document sheet is placed, a document sheet transportation path, and a feeding portion. The document sheet transportation path is provided to extend from the document sheet placement portion to form a transportation path of the document sheet. The feeding portion feeds the document sheet toward the document sheet transportation path.

The feeding portion includes a holder, a feeding member, a supporting body, a stopper member, and a biasing member. The feeding member is rotatably supported by the holder to feed the document sheet along a predetermined first direction. The supporting body has a first shaft portion and is supported, in the holder, at an upstream side of the feeding member in the first direction. The stopper member is a member which has a contact end portion allowed to contact a front end of the document sheet in the first direction, the sheet being placed on the document sheet placement portion, which is rotatably supported around the first shaft portion by the supporting body, and which regulates feeding of the document sheet by the feeding member by contact of the contact end portion with the front end of the document sheet. The biasing member applies a biasing force around the first shaft portion to the stopper member.

The stopper member is allowed to change a position among a first position, a second position, and a third position. The first position is a position in which the contact end portion contacts the front end of the document sheet. The second position is a position in which the contact end portion is separated from the front end of the document sheet to face the first direction, thereby allowing feeding of the document sheet by the feeding member. The third position is a position in which the contact end portion rotates from the second position in a first rotating direction around the first shaft portion so as to face a second direction reverse to the first direction. The biasing member applies the biasing force to the stopper member in a second rotating direction reverse to the first rotating direction around the first shaft portion.

Additionally, an image forming apparatus according to another aspect of the present disclosure includes the above document sheet transportation device, a document sheet reading portion which reads a document image of a document sheet transported by the document sheet transportation device to output image data according to the document image, and an image forming portion which forms an image on the basis of the image data on a sheet.

DETAILED DESCRIPTION

In the following, description will be made of a document sheet transportation device and an image forming apparatus according to one embodiment of the present disclosure with reference to the drawings. The following description will be made using XYZ orthogonal coordinate axes regarding directions. An X direction corresponds to a right-left direction (+X represents right and −X represents left), a Y direction corresponds to a front-rear direction (+Y represents front and −Y represents rear), and a Z direction corresponds to an up-down direction (+Z represents up and −Z represents down). Additionally, in the following description, the term "sheet" denotes copy paper, coated paper, an OHP sheet, a board, a postcard, tracing paper, other sheet material to be subjected to image forming processing, or a sheet material to be subjected to other arbitrary processing than the image forming processing.

[Entire Configuration of Image Forming Apparatus]

Figure 1:
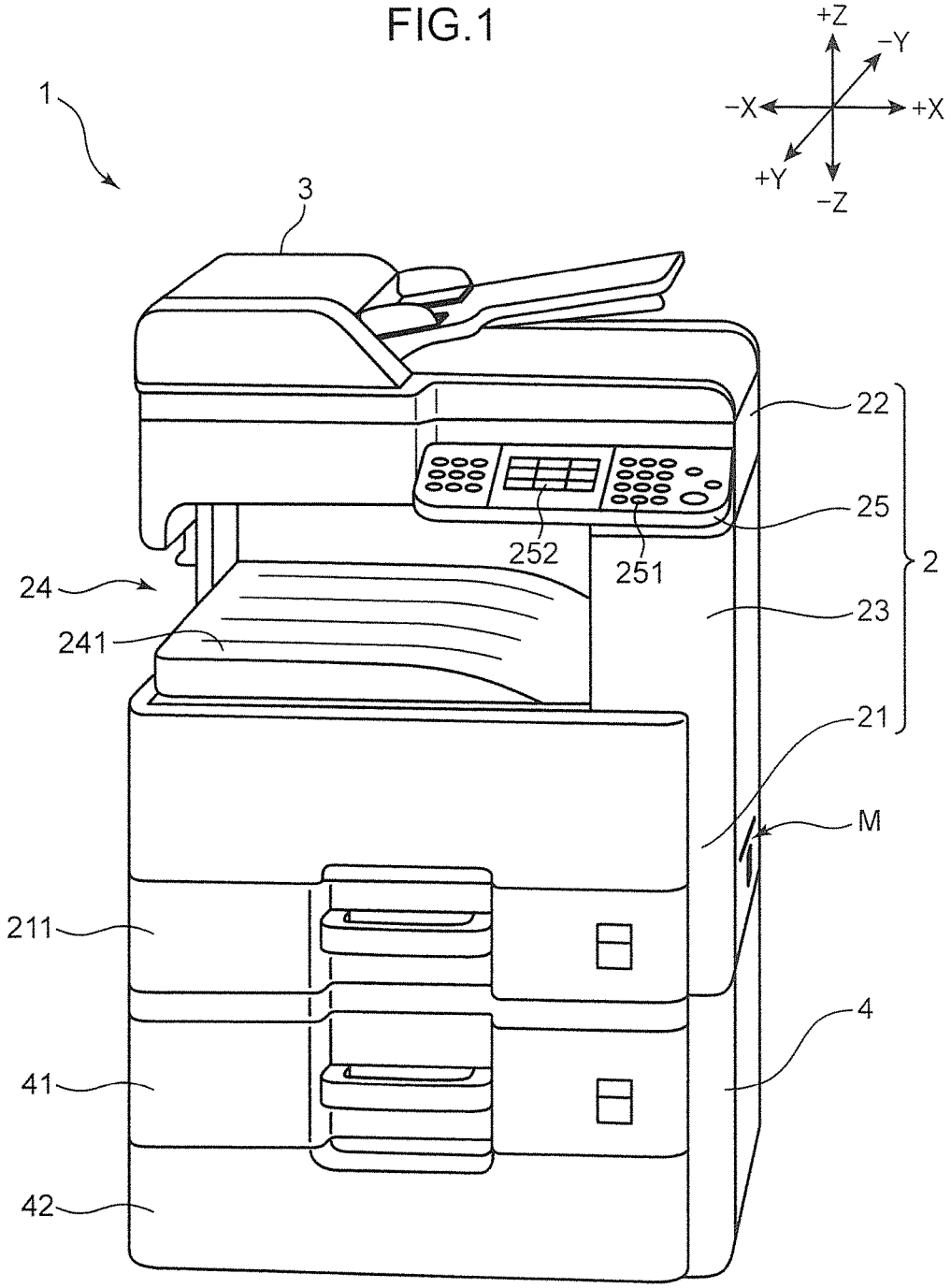
FIG. 1 is a perspective view showing an appearance of an image forming apparatus to which a document sheet transportation device according to one embodiment of the present disclosure is applied.
Figure 2:
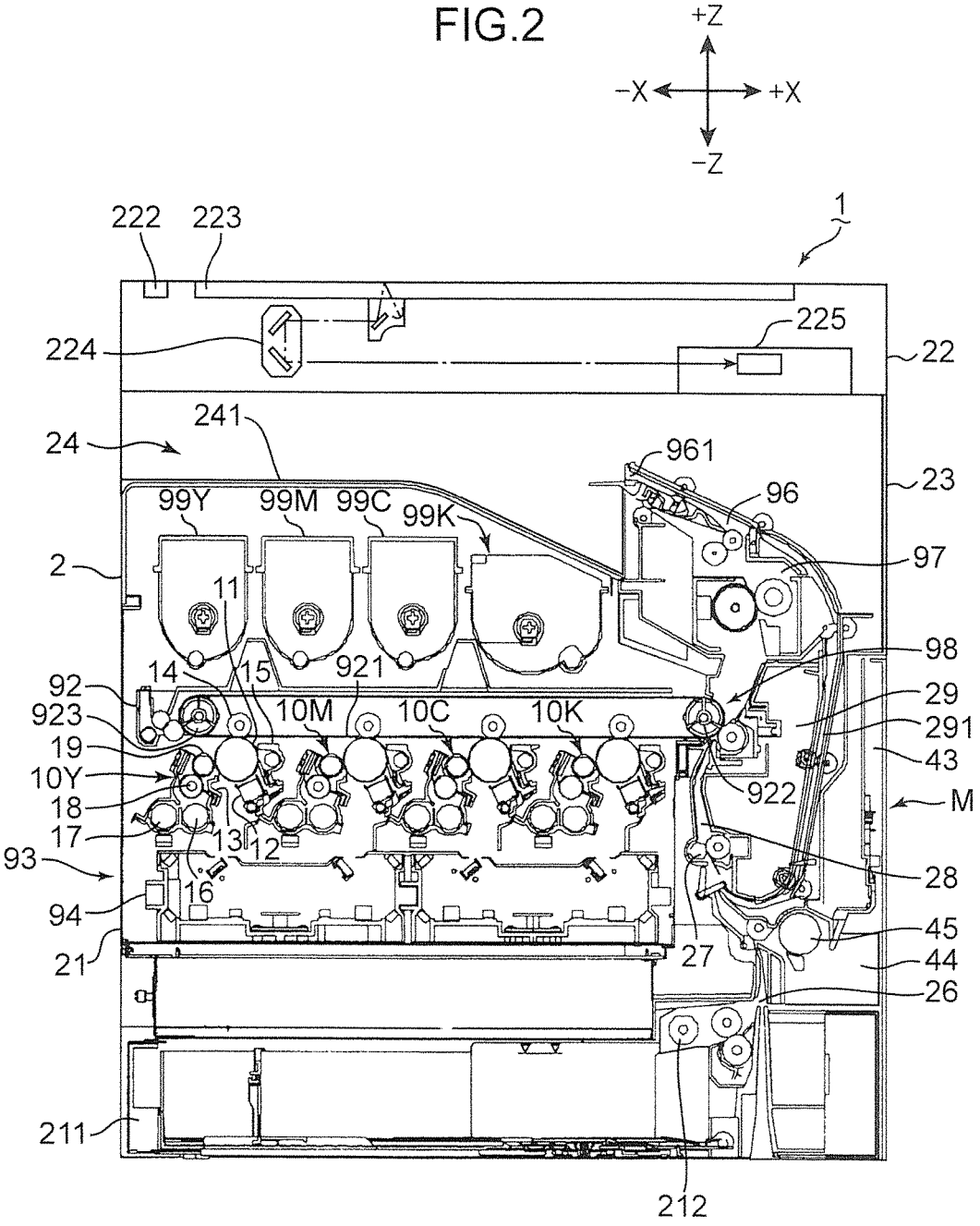
FIG. 2 is a sectional view showing an internal structure of the image forming apparatus.

FIG. 1 is a perspective view showing an appearance of an image forming apparatus 1 to which a document sheet transportation device 3 according to one embodiment of the present disclosure is applied. FIG. 2 is a sectional view showing an internal structure of the image forming apparatus 1. In the present embodiment, as the image forming apparatus 1, an in-body paper ejection type color copying machine equipped with an automatic document feeder (ADF) which is one specific example of the document sheet transportation device 3 is described. The apparatus to which the document sheet transportation device 3 of the present disclosure is applied is not limited to the present embodiment, but may be, for example, a monochrome copying machine, a facsimile device, or a multifunctional machine.

The image forming apparatus 1 includes an apparatus main body 2 provided with an in-body space (an in-body paper ejection portion 24) having a substantially rectangular parallelepiped casing structure, the document sheet transportation device 3 arranged on an upper surface of the apparatus main body 2, and a paper feeding expansion unit 4 assembled under the apparatus main body 2.

The apparatus main body 2 includes a substantially rectangular parallelepiped lower casing 21, a substantially rectangular parallelepiped upper casing 22 disposed above the lower casing 21, and a linkage casing 23 which links the lower casing 21 and the upper casing 22. In the lower casing 21, various equipment for conducting image forming processing for a sheet is housed, and in the upper casing 22, various equipment for optically reading a document image of a document sheet is housed. The in-body space surrounded by the lower casing 21, the upper casing 22, and the linkage casing 23 is set to be the in-body paper ejection portion 24 capable of housing a sheet having an image formed thereon. The linkage casing 23 is arranged on a +X side (the right side) of the apparatus main body 2 and is provided with an ejection port 961 for ejecting a sheet to the in-body paper ejection portion 24. The in-body space used as the in-body paper ejection portion 24 is externally opened on a +Y side (the front side) and a −X side (the left side) of the apparatus main body 2. A lower surface portion 241 of the in-body paper ejection portion 24 is sectioned on an upper surface of the lower casing 21, on which surface a sheet ejected from the ejection port 961 is loaded.

To the lower casing 21, a paper feeding cassette 211 which houses sheets to be subjected to the image forming processing is attached. The paper feeding expansion unit 4 also includes paper feeding cassettes 41 and 42 which house sheets to be subjected to the image forming processing. These paper feeding cassettes 211, 41, and 42 are provided for automatic paper feeding, and are capable of housing a large number of sheets by size. Additionally, the paper feeding cassettes 211, 41, and 42 can be drawn out frontward from a front surface of the lower casing 21 or the paper feeding expansion unit 4.

To a side surface of the apparatus main body 2 on the +X side, a multi tray unit M for user's manual paper feeding is attached. The multi tray unit M includes a paper feeding tray 43 on which manually fed sheets are placed, and a paper feeding unit 44 which carries sheets into the image forming portion in the lower casing 21. The paper feeding tray 43 is attached to be freely opened and closed at a lower end portion thereof to the lower casing 21, and is closed when not used. At the time of manual paper feeding, a user opens the paper feeding tray 43 to place sheets thereon.

In the upper casing 22, an operation panel unit 25 is provided to protrude. The operation panel unit 25, which is equipped with an operation key 251 including a ten key, a start key, etc. and with an LCD touch panel 252, receives input of various operation instructions from a user. The user is allowed to input the number of sheets to be printed, a print concentration, and the like through the operation panel unit 25.

In an upper surface of the upper casing 22, a first contact glass 222 and a second contact glass 223 are fit in. The first contact glass 222 is provided for reading a document sheet transported by the document sheet transportation device 3. The second contact glass 223 is provided for reading a manually placed document sheet.

Inside the upper casing 22, a scan mechanism 224 for optically reading a document image of a document sheet and an image pickup device 225 are housed. In the present embodiment, the scan mechanism 224 and the image pickup device 225 configure a document reading portion. The scan mechanism 224, which includes a light source, a movable carriage, a reflection mirror, etc., guides a reflected light from a document sheet to the image pickup device 225. The image pickup device 225 photoelectrically converts the reflected light into an analog electric signal. After being converted into a digital electric signal by an A/D conversion circuit, the analog electric signal is output as image data. The output image data is input to a light exposure unit 94 to be described later.

The document sheet transportation device 3 automatically transports a document sheet to be read via an image reading position set on the upper surface of the upper casing 22 (an upper surface of the first contact glass 222). The document sheet transportation device 3 will be described later in detail.

Inside the lower casing 21, there are sequentially housed, from the top, the toner containers 99Y, 99M, 99C, and 99K, an intermediate transfer unit 92, an image forming portion 93, the light exposure unit 94, and the above paper feeding cassette 211.

The image forming portion 93 is provided with four image forming units 10Y, 10M, 10C, and 10K which form respective toner images of yellow (Y), magenta (M), cyan (C), and black (K) for forming full color toner images. Each of the image forming units 10Y, 10M, 10C, and 10K includes a photosensitive drum 11, a charger 12, a developing device 13, a primary transfer roller 14, and a cleaning device 15 which are arranged around the photosensitive drum 11.

The photosensitive drum 11 has a circumference surface which rotates around an axis thereof and carries an electrostatic latent image and a toner image. The charger 12 evenly charges a surface of the photosensitive drum 11. The circumference surface being charged of the photosensitive drum 11 is subjected to light exposure by the light exposure unit 94 on the basis of image data to form an electrostatic latent image.

The developing device 13 supplies the circumference surface of the photosensitive drum 11 with toner for developing an electrostatic latent image formed on the photosensitive drum 11. The developing device 13, which is for a two-component developing agent, includes stirring rollers 16 and 17, a magnetic roller 18, and a developing roller 19. The stirring rollers 16 and 17 charge the toners by circularly transporting a two-component developing agent while stirring the same. A circumference surface of the magnetic roller 18 carries a two-component developing agent layer and a circumference surface of the developing roller 19 carries a toner layer formed by sending/reception of toner caused by a potential difference between the magnetic roller 18 and the developing roller 19. The toner on the developing roller 19 is supplied to the circumference surface of the photosensitive drum 11 to develop the electrostatic latent image. As a result, a toner image is formed on the circumference surface of the photosensitive drum 11.

Together with the photosensitive drum 11, the primary transfer roller 14 forms a nip portion with an intermediate transfer belt 921 in the intermediate transfer unit 92 provided therebetween, and conducts primary transfer of a toner image on the photosensitive drum 11 to the intermediate transfer belt 921. The cleaning device 15 cleans the circumference surface of the photosensitive drum 11 to which the toner image has been transferred.

The toner container for yellow 99Y, the toner container for magenta 99M, the toner container for cyan 99C, and the toner container for black 99K are for storing the toners of the respective colors to replenish the developing devices 13 of image forming units 10Y, 10M, 10C, and 10K corresponding to the respective colors Y, M, C, and K with the toners of the respective colors through a supply path whose illustration is omitted.

The light exposure unit 94, which has various kinds of optical system equipment such as a light source, a polygon mirror, a reflection mirror, a deflection mirror, and the like, irradiates the circumference surface of the photosensitive drum 11 provided in each of the image forming units 10Y, 10M, 10C, and 10K with light on the basis of image data of a document image to form an electrostatic latent image.

The intermediate transfer unit 92 is provided with the intermediate transfer belt 921, a driving roller 922, and a follower roller 923. On the intermediate transfer belt 921, toner images from the plurality of photosensitive drums 11 are repeatedly painted (primary transfer). The repeatedly painted toner image is secondarily transferred to a sheet supplied from the paper feeding cassette 211 in a secondary transfer portion 98. The driving roller 922 and the follower roller 923 which circularly drive the intermediate transfer belt 921 are rotatably supported by the lower casing 21.

The paper feeding cassette 211 houses a bundle of sheets formed of a plurality of stacked sheets. Above an end portion of the paper feeding cassette 211 on the +X side, a pickup roller 212 is arranged. Being driven by the pickup roller 212, sheets in an uppermost layer of the bundle of sheets in the paper feeding cassette 211 are sent out one by one to be carried into a carry-in transportation path 26. On the other hand, manually fed sheets placed on the paper feeding tray 43 are carried into the carry-in transportation path 26 by driving of a paper feeding roller 45 of the paper feeding unit 44.

On a downstream side of the carry-in transportation path 26, a sheet transportation path 28 is provided which extends to the ejection port 961 via the secondary transfer portion 98, and a fixing unit 97 and a paper ejection unit 96 which will be described later. An upstream part of the sheet transportation path 28 is formed between an inner wall formed in the lower casing 21 and an inner wall forming an inner side surface of a reverse transportation unit 29. An outer side surface of the reverse transportation unit 29 configures one side surface of a reverse transportation path 291 which reversely transports a sheet at the time of double-sided printing. A pair of resist rollers 27 is arranged more upstream of the sheet transportation path 28 than the secondary transfer portion 98. The sheet is once stopped by the pair of resist rollers 27 and, after skew correction is conducted, sent to the secondary transfer portion 98 at predetermined timing for image transfer.

Inside the linkage casing 23, the fixing unit 97 and the paper ejection unit 96 are housed. The fixing unit 97, which includes a fixing roller and a pressurizing roller, executes fixing processing by heating and pressurizing a sheet to which a toner image has been secondarily transferred at the secondary transfer portion 98. The sheet with a color image subjected to the fixing processing is ejected from the ejection port 961 toward the in-body paper ejection portion 24 by the paper ejection unit 96 arranged downstream of the fixing unit 97.

[Configuration of Document Sheet Transportation Device]

<Entire Configuration of Document Sheet Transportation Device>

Figure 3:
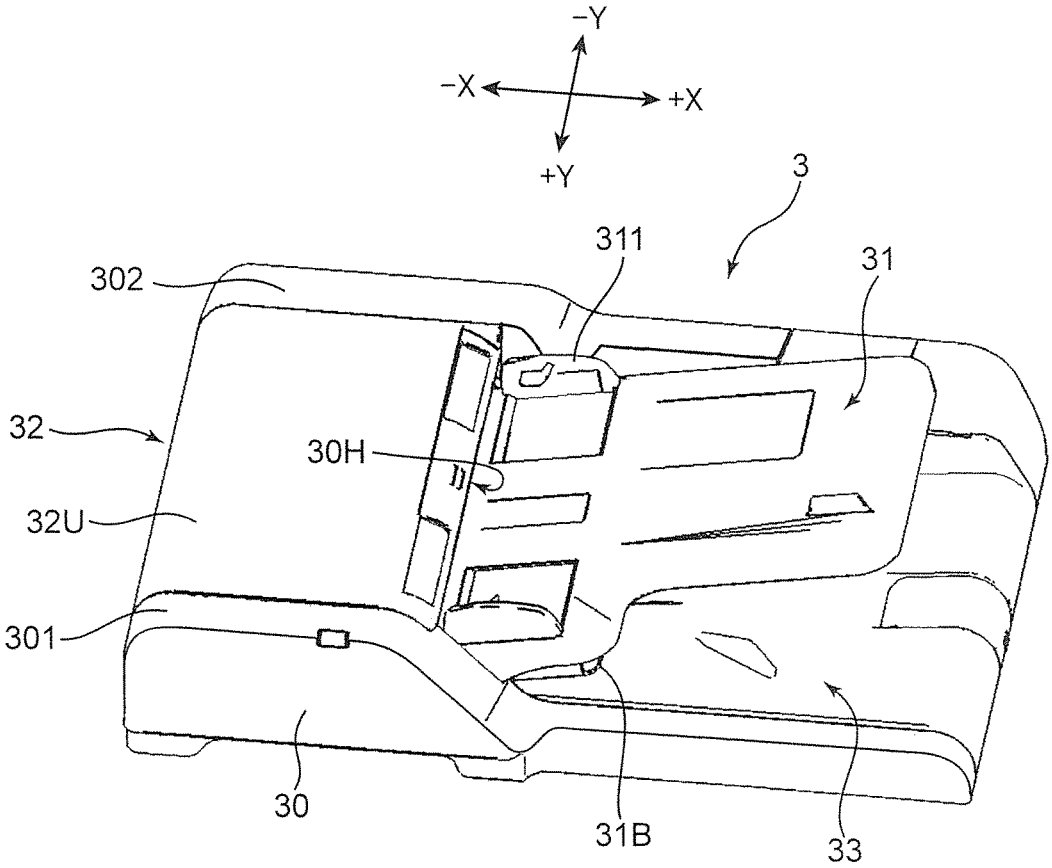
FIG. 3 is a perspective view showing an appearance of the document sheet transportation device.
Figure 4:
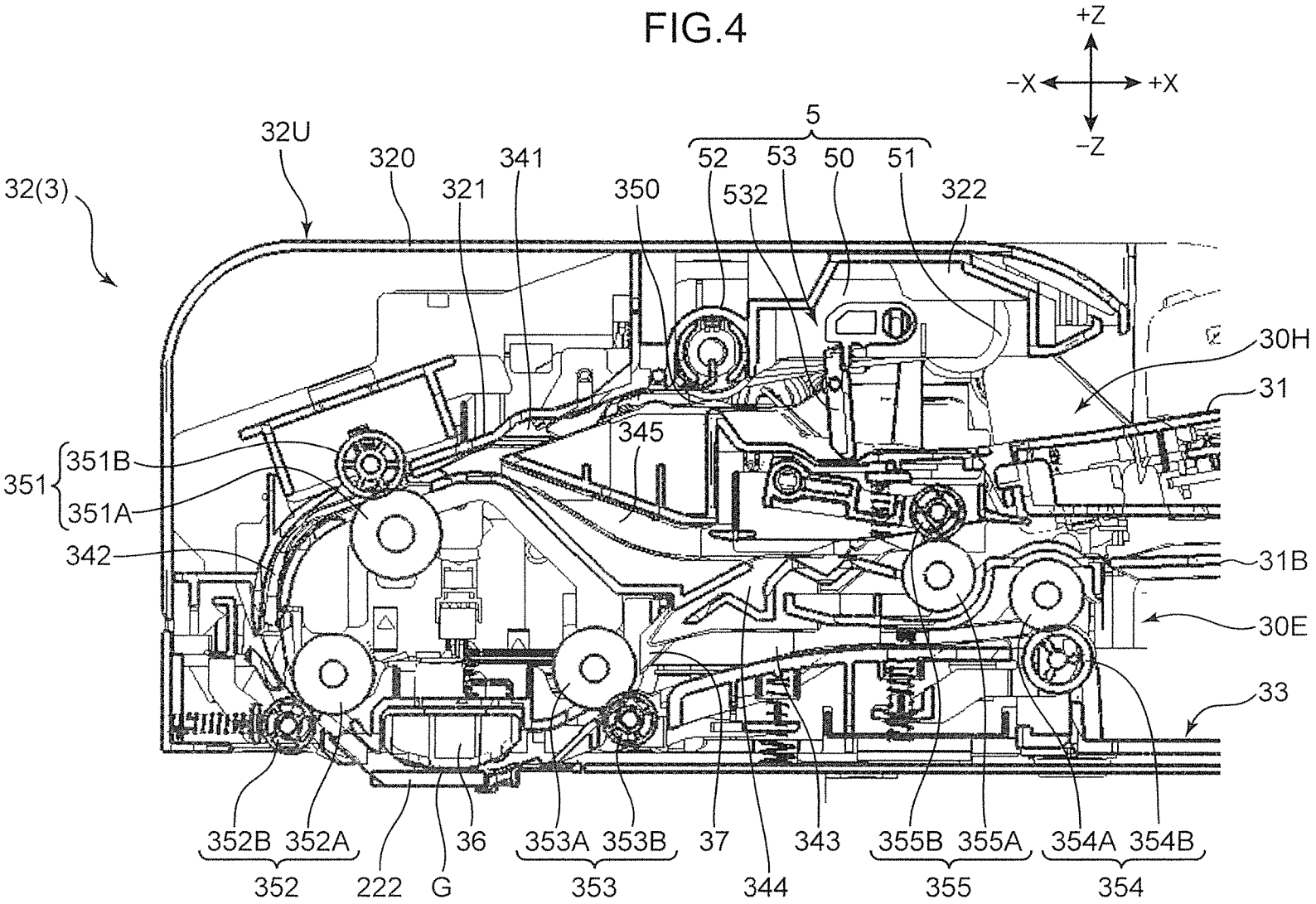
FIG. 4 is a sectional view showing an enlarged main part of the document sheet transportation device.
Figure 5:
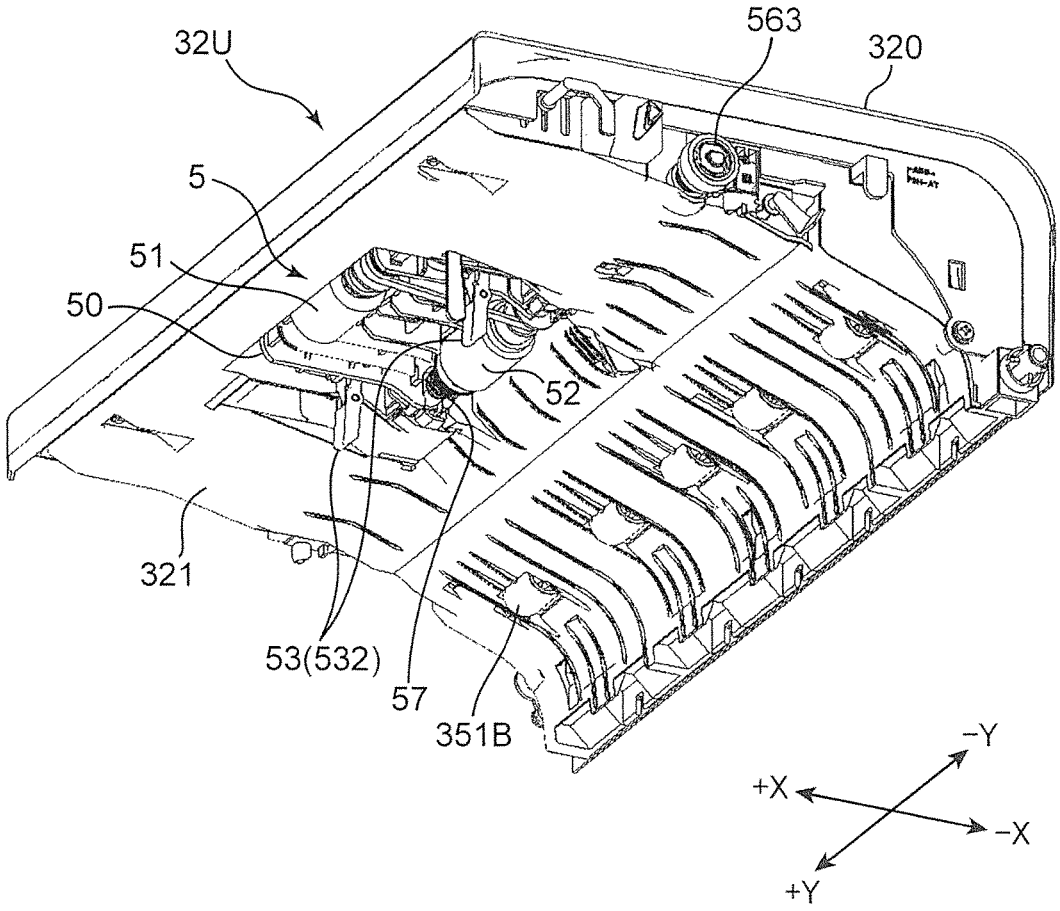
FIG. 5 is a perspective view of a cover body of the document sheet transportation device seen from a lower surface side.

Next, the document sheet transportation device 3 will be described in detail. FIG. 3 is a perspective view showing an appearance of the document sheet transportation device 3. FIG. 4 is a sectional view showing an enlarged main part of the document sheet transportation device 3. FIG. 5 is a perspective view of a cover body 32U of the document sheet transportation device 3 seen from a lower surface side. The document sheet transportation device 3 is provided with a main body housing 30, a document feeding tray 31, a document transportation portion 32, a document ejection tray 33, a document reversing tray 31B, and a document feeding unit 5. The main body housing 30 is a casing which houses various kinds of mechanisms provided in the document sheet transportation device 3. In a −X side part where the document transportation portion 32 is housed, the main body housing 30 has an upwardly rising front wall portion 301 and a rear wall portion 302.

The document feeding tray 31 is a tray on which a document sheet to be fed to the image reading position is placed. The document feeding tray 31 is one example of the document sheet placement portion. The document feeding tray 31 is attached to the main body housing 30 so as to externally extend from a feeding port 30H of the main body housing 30. The document feeding tray 31 is provided with a pair of cursors 311 for adjusting a width of a placed document sheet.

The document ejection tray 33 is a tray to which a document sheet whose document image has been optically read is ejected. An upper surface of a +X side part of the main body housing 30 is set to be the document ejection tray 33. The document reversing tray 31B is a tray to which a document sheet having document images on both faces is temporarily ejected at the time of reading the document sheet.

The document transportation portion 32 is a part which transports a document sheet on the document feeding tray 31, which sheet is fed by the document feeding unit 5 to be described later, up to the document ejection tray 33 via an image reading position G. The document transportation portion 32 is provided with first to fifth transportation paths 341 to 345 serving as a transportation path of a document sheet, and first to fifth transportation roller pairs 351 to 355 arranged at appropriate places of the first to fifth transportation paths 341 to 345. Additionally, the document transportation portion 32 includes the cover body 32U.

The cover body 32U is capable of opening and closing the main body housing 30 and is fit in an opening between the front wall portion 301 and the rear wall portion 302 of the main body housing 30.

The first, second, and third transportation paths 341, 342, and 343 configure a document sheet transportation path curved to be U-shaped, the path being provided to extend from the feeding port 30H of the document feeding tray 31 to a paper ejection port 30E which ejects a document sheet to the document ejection tray 33 via the image reading position G. On the other hand, the fourth and fifth transportation paths 344 and 345 are switchback transportation paths for use in reversing a document sheet having document images on both faces at the time of reading the document sheet.

The first transportation path 341 is a transportation path continuous with the document feeding tray 31 to extend so as to slightly lower forward from the feeding port 30H toward the −X side, and is a transportation path through which a document sheet fed from the document feeding unit 5 first passes. An upper transportation surface of the first transportation path 341 is defined by a guide member 321 of the cover body 32U (see FIG. 5). The second transportation path 342 is a circular are-shaped transportation path extending from a downstream end of the first transportation path 341 to a position opposed to the first contact glass 222, which is a document reading position G. One transportation surface of the second transportation path 342 is also defined by the guide member 321 of the cover body 32U. The third transportation path 343 is a transportation path extending so as to slightly upper forward from the position opposed to the first contact glass 222 in the +X direction to the paper ejection port 30E. At the position opposed to the first contact glass 222, a contact surface guide 36 is arranged which causes a document sheet to slidingly contact the first contact glass 222.

The fourth transportation path 344 is a transportation path which branches from the third transportation path 343 to extend in an upper right direction. A distribution lever 37 is arranged at a branch portion between the third transportation path 343 and the fourth transportation path 344. The distribution lever 37, at the time of ordinary one-side reading, guides a document sheet to the third transportation path 343, and at the time of execution of double-side reading of a document sheet, when reversing upside down the document sheet whose one-side reading has been finished is required, guides the document sheet to the fourth transportation path 344. The fifth transportation path 345 is a substantially horizontal transportation path communicating with the fourth transportation path 344 and the first transportation path 341, and the document reversing tray 31B. The fifth transportation path 345 is a transportation path which receives a document sheet to be reversed upside down from the fourth transportation path 344 and switchback-transports the document sheet to the first transportation path 341.

The first transportation roller pair 351 is formed of a combination of a driving roller 351A which generates a rotation driving force for transporting a document sheet and a follower roller 351B which is brought into contact with the driving roller 351A to rotate following the same. The first transportation roller pair 351 is arranged between the first transportation path 341 and the second transportation path 342 to transport a document sheet toward the largely curved second transportation path 342. The follower roller 351B of the first transportation roller pair 351 is rotatably attached to the cover body 32U as shown in FIG. 5.

The second transportation roller pair 352, similarly to the first transportation roller pair 351, is formed of a combination of a driving roller 352A and a follower roller 352B. The second transportation roller pair 352 is arranged directly upstream of the document reading position G to send out a document sheet to the document reading position G. The third transportation roller pair 353, similarly to the first transportation roller pair 351, is formed of a combination of a driving roller 353A and a follower roller 353B. The third transportation roller 353 is arranged directly downstream of the document reading position G to send out a document sheet, whose image has been read, to the third transportation path 343 or the fourth transportation path 344. The fourth transportation roller pair 354, similarly to the first transportation roller pair 351, is formed of a combination of a driving roller 354A and a follower roller 354B. The fourth transportation roller pair 354 is arranged in the vicinity of the paper ejection port 30E to eject a document sheet toward the document ejection tray 33. The fifth transportation roller pair 355, similarly to the first transportation roller pair 351, is formed of a combination of a driving roller 355A and a follower roller 355B. The fifth transportation roller pair 355, which is a roller pair capable of forward rotation and backward rotation and is arranged on the fifth transportation path 345, executes switchback-transportation of a document sheet by making use of the document reversing tray 31B.

<Document Feeding Unit>

Figure 6:
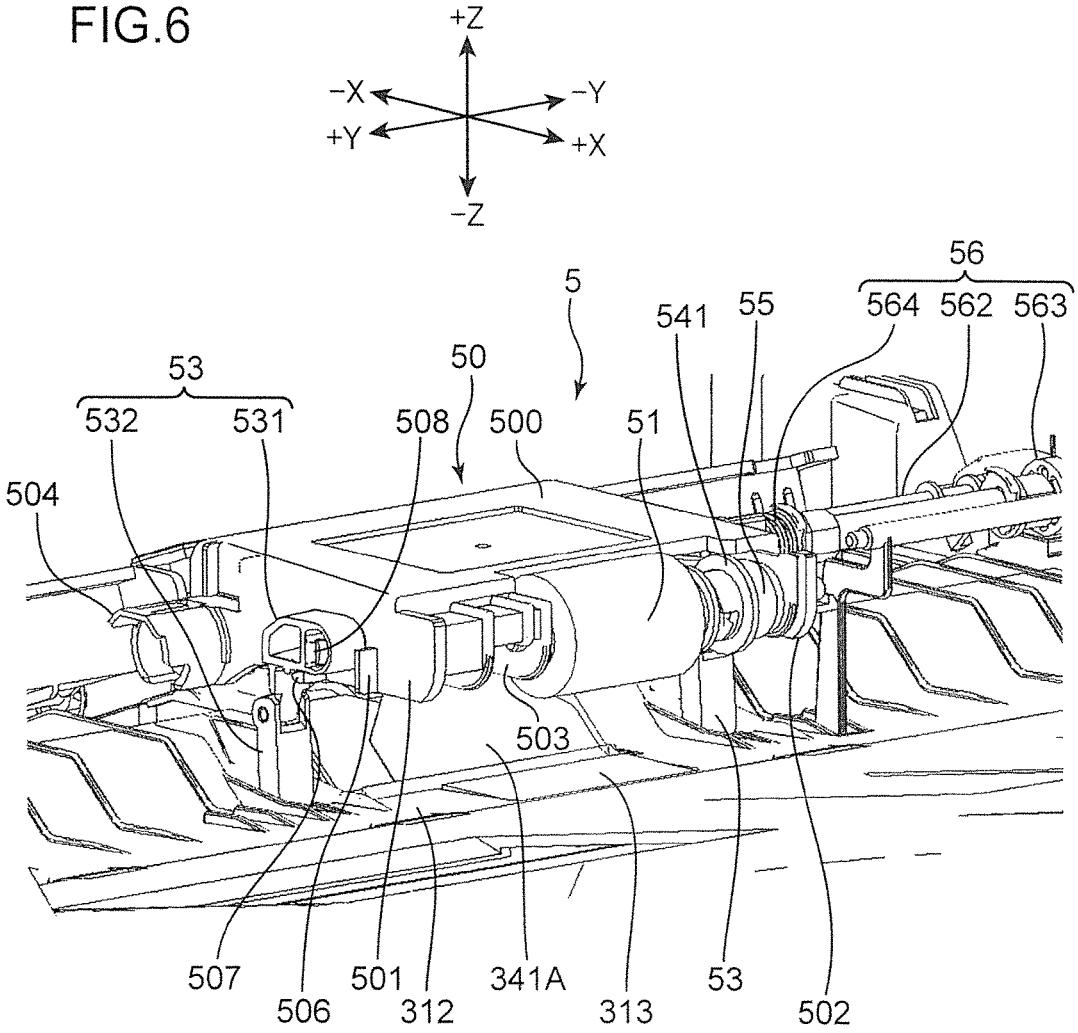
FIG. 6 is a perspective view showing an enlarged document feeding unit of the document sheet transportation device.
Figure 7:
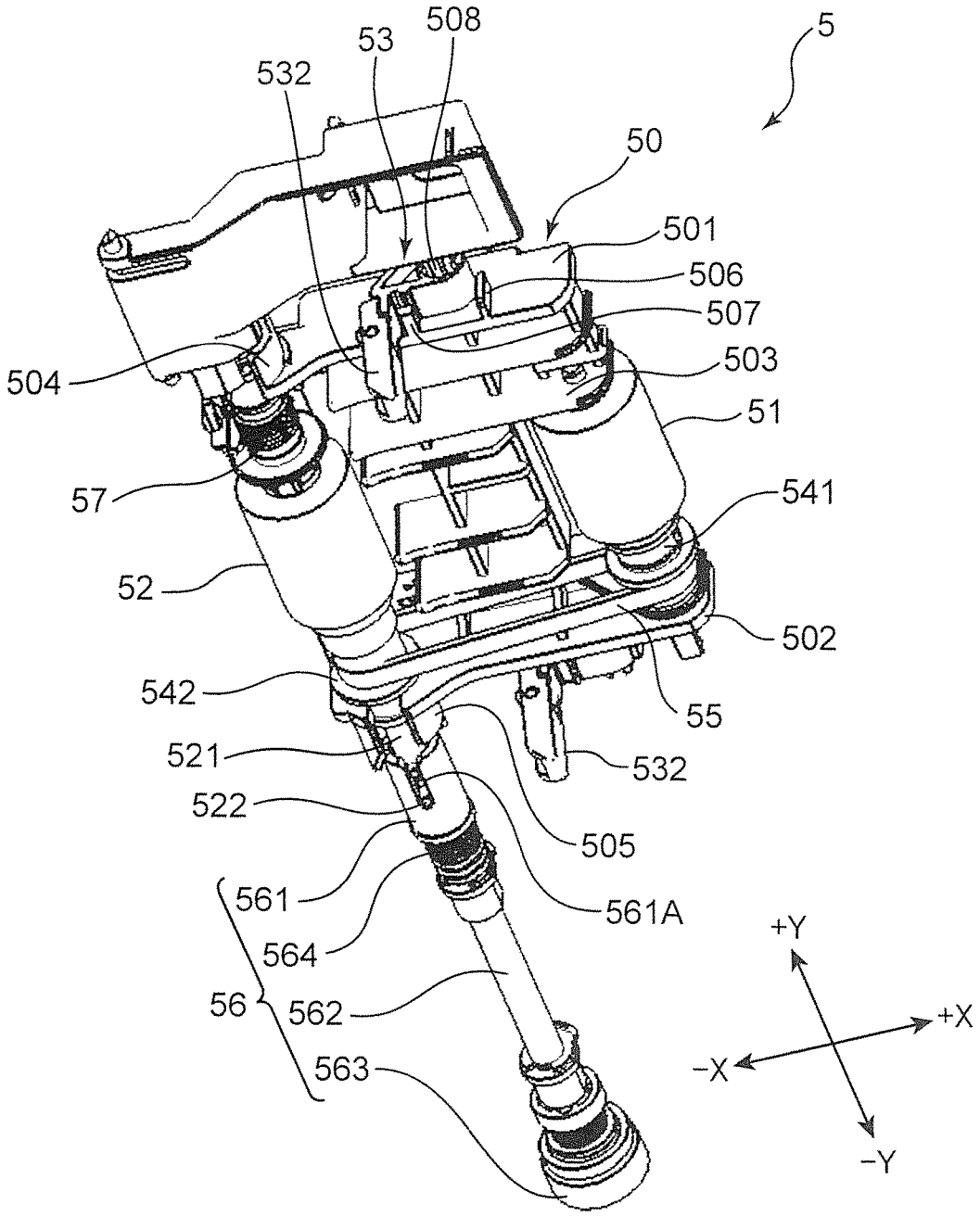
FIG. 7 is a perspective view of the document feeding unit seen from a lower surface side.
Figure 8:
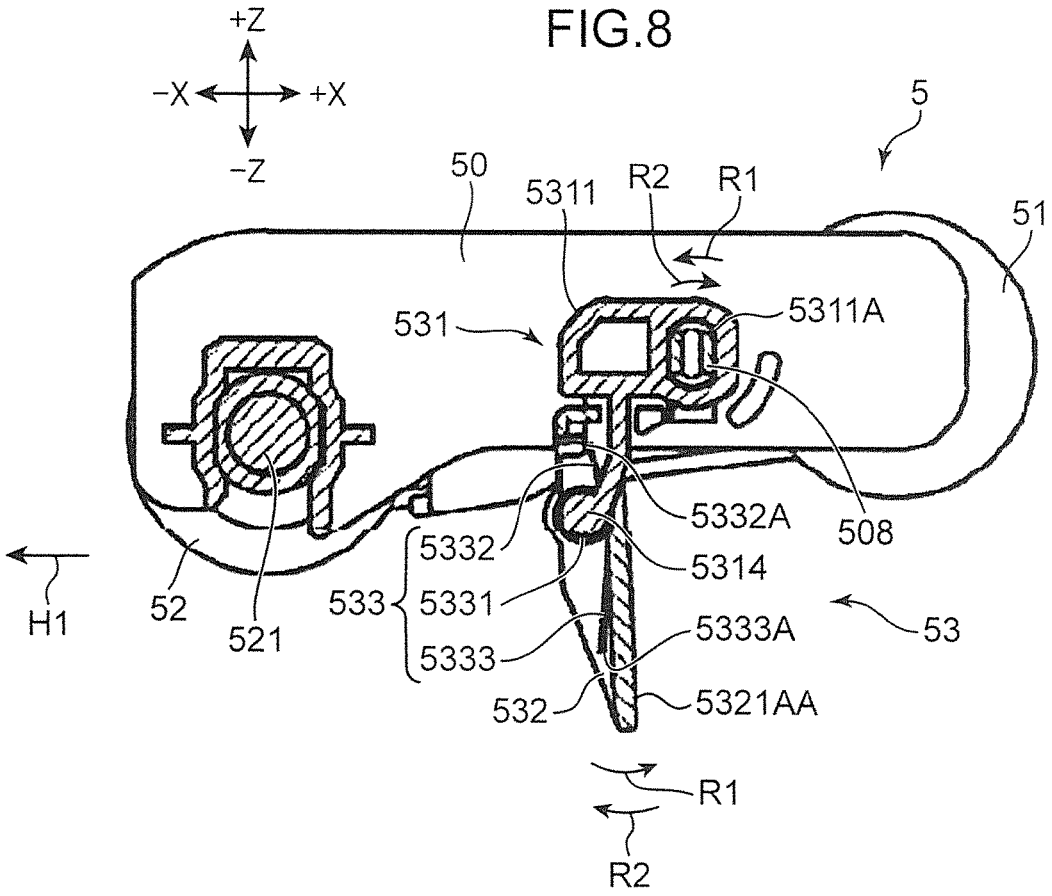
FIG. 8 is a sectional view showing the document feeding unit.

The document feeding unit 5 is a unit having a function as the feeding portion which feeds a document sheet placed on the document feeding tray 31 toward the first transportation path 341 of the document transportation portion 32. The document feeding unit 5, as shown in FIG. 5, is assembled in the cover body 32U. With reference to FIG. 6 to FIG. 8 in addition to FIG. 4 and FIG. 5, a configuration of the document feeding unit 5 will be described. FIG. 6 is a perspective view showing an enlarged document feeding unit 5 of the document sheet transportation device 3. FIG. 7 is a perspective view of the document feeding unit 5 seen from a lower surface side. FIG. 8 is a sectional view showing the document feeding unit 5.

The document feeding unit 5 is configured to include a holder 50, a pickup roller 51, a document feeding roller 52 (a feeding member), a stopper mechanism 53, and a swing mechanism 56.

The holder 50 is a box-shaped member including a flat plate-shaped upper plate 500, a front plate 501, a rear plate 502 and a middle plate 503 which are made of rib members integral with the upper plate 500. A front cylindrical portion 504 and a rear cylindrical portion 505, which are coaxially arranged, are provided to protrude on the front plate 501 and the rear plate 502. The holder 50 is swung around the center of the cylinders of the front cylindrical portion 504 and the rear cylindrical portion 505 by the swing mechanism 56.

A rotating force for rotating around a shaft of the pickup roller 51 is applied to the pickup roller 51, and therefore the pickup roller 51 sends out document sheets placed on the document feeding tray 31 one by one toward the document feeding roller 52. The rotation shaft of the pickup roller 51 is rotatably supported at the right end side of the rear plate 502 and the middle plate 503 of the holder 50. When the holder 50 is swung around the center of the cylinders of the front cylindrical portion 504 and the rear cylindrical portion 505 by the swing mechanism 56, the pickup roller 51 changes a position between a paper feeding position at which the holder 50 contacts the upper face of a document sheet on the document feeding tray 31 and a retreat position spaced above from the upper face of the document sheet. As shown in FIG. 6, at a downstream end 312 of the document feeding tray 31, a separating pad 313 is arranged at a position opposed to the pickup roller 51. When the pickup roller 51 is at the paper feeding position, the nip portion is formed between the pickup roller 51 and the separating pad 313.

The document feeding roller 52 feeds one document sheet sent out from the pickup roller 51 toward the first transportation path 341 of the document transportation portion 32 along a predetermined first direction H1. Here, the first direction H1 is a direction directed from the +X side (the right side) to the −X side (the left side). A rotation shaft 521 of the document feeding roller 52 is rotatably supported by the front plate 501 and the rear plate 502 of the holder 50. When a document sheet feeding operation is conducted in the document feeding roller 52, a rotation driving force is applied to the rotation shaft 521 to rotate the document feeding roller 52. As shown in FIG. 4, in the main body housing, a follower roller 350 is arranged so as to be opposed to the document feeding roller 52. The front cylindrical portion 504 and the rear cylindrical portion 505 of the holder 50 are rotatably attached around the rotation shaft 521. In other words, an axis of the rotation shaft 521 and the center of cylinders of the front cylindrical portion 504 and the rear cylindrical portion 505 of the holder 50 are coaxial, so that even when the holder 50 swings, the document feeding roller 52, without moving vertically, constantly forms a paper feeding nip portion together with the follower roller 350.

To a rotation shaft of the pickup roller 51, a first wheel 541 with a number of grooves formed on an outer circumference surface thereof is fixed. Additionally, to the rotation shaft 521 of the document feeding roller 52, a second wheel 542 provided with similar grooves is fixed (see FIG. 7). These first and second wheels 541 and 542 are each arranged at a position on a −Y side (rear side) of the pickup roller 51 and the document feeding roller 52. An endless belt 55 (transmission mechanism) for power transmission is bridged over the first and second wheels 541 and 542. On an inner circumference surface of the endless belt 55, a number of protrusions engaging with the grooves provided in the first and second wheels 541 and 542 are formed. When a rotation driving force (a rotation driving force in a positive direction) is applied to the rotation shaft 521 of the document feeding roller 52 in a direction where a document sheet is sent (the first direction H1), the rotating force is transmitted to the rotation shaft of the pickup roller 51 through the endless belt 55. As a result, both of the pickup roller 51 and the document feeding roller 52 rotate in synchronization with each other.

The swing mechanism 56 is a mechanism for transmitting a rotation driving force in the positive direction or reverse direction of a driving motor (not shown) to the rotation shaft 521 of the document feeding roller 52. The swing mechanism 56 is provided with a coupling portion 561, a shaft portion 562, a driving input portion 563, and a pressing spring 564.

The coupling portion 561 is a part which engages with the rotation shaft 521 and has a cylindrical shape that receives the rotation shaft 521. On a cylindrical wall of the coupling portion 561, a groove portion 561A is provided to extend in an axis direction of the rotation shaft 521. By contrast, a pin 522 is provided to protrude from a circumference wall of the rotation shaft 521, and fitting of the pin 522 into the groove portion 561A attains the engagement. The pressing spring 564 biases the coupling portion 561 in the +Y side (the front side) direction, thereby ensuring engagement of the groove portion 561A with the pin 522.

A rotation driving force via a not-shown gear mechanism from the driving motor is applied to the driving input portion 563. The coupling portion 561, the shaft portion 562, and the driving input portion 563 are integrated. When the driving input portion 563 is rotated, the coupling portion 561 is also rotated and a rotation driving force thereof is transmitted to the rotation shaft 521. Accordingly, the pickup roller 51 and the document feeding roller 52 are rotated.

As described above, because the front cylindrical portion 504 and the rear cylindrical portion 505 of the holder 50 are inserted into the rotation shaft 521, the holder 50 is rotatable around the axis of the rotation shaft 521. Therefore, when a rotation driving force in the positive direction is applied to the rotation shaft 521, a clockwise (in the positive direction) moment acts on the holder 50. As a result, the holder 50 rotates (swings) clockwise around the axis of the rotation shaft 521. This makes the pickup roller 51 move to the paper feeding position that is in contact with an upper face of a document sheet placed on the document feeding tray 31. On the other hand, when a rotation driving force in the reverse direction is applied to the rotation shaft 521, a counterclockwise (in the reverse direction) moment acts on the holder 50. As a result, the holder 50 rotates (swings) counterclockwise around the axis of the rotation shaft 521. This makes the pickup roller 51 move to the retreat position spaced above from the upper face of the document sheet. FIG. 4 and FIG. 6 show a state where the pickup roller 51 moves to the retreat position.

Additionally, as shown in FIG. 7, the document feeding unit 5 includes a spring member 57. The spring member 57 is a torsion coil spring having a coil portion inserted into the rotation shaft 521. The spring member 57 biases the holder 50 such that the pickup roller 51 maintains the retreat position. A biasing force of the spring member 57 is set to be smaller than a clockwise moment generated in the holder 50 when a rotation driving force in the positive direction is applied to the rotation shaft 521. Accordingly, when the rotation shaft 521 rotates in the positive direction at the time of document sheet feeding, the holder 50 rotates (swings) clockwise around the axis of the rotation shaft 521 against the biasing force of the spring member 57. By contrast, when a rotation driving force in the reverse direction is applied to the rotation shaft 521 to move the pickup roller 51 to the retreat position, the posture of the holder 50 at this time is maintained by the biasing force of the spring member 57. At the retreat position, the holder 50 abuts on a top 320 of the cover body 32U.

<Stopper Mechanism>

The stopper mechanism 53 is attached to each outer surface side of the front plate 501 and the rear plate 502 of the holder 50 so as to be positioned between the pickup roller 51 and the document feeding roller 52 in the X direction (right and left direction). Since each stopper mechanism 53 has the same configuration, description will be here made of the stopper mechanism 53 attached to the front plate 501.

The stopper mechanism 53 has a function of contacting a front end of a document sheet in the first direction H1 to align the front end of the document sheet before the pickup roller 51 starts an operation of sending the document sheet to the document feeding roller 52. By aligning the front end of the document sheet by the stopper mechanism 53, the document sheet is prevented from being sent to the first transportation path 341 in an oblique posture. Additionally, the stopper mechanism 53 has a function of regulating feeding of a document sheet by the document feeding roller 52 by contacting the front end of the document sheet.

Figure 9:
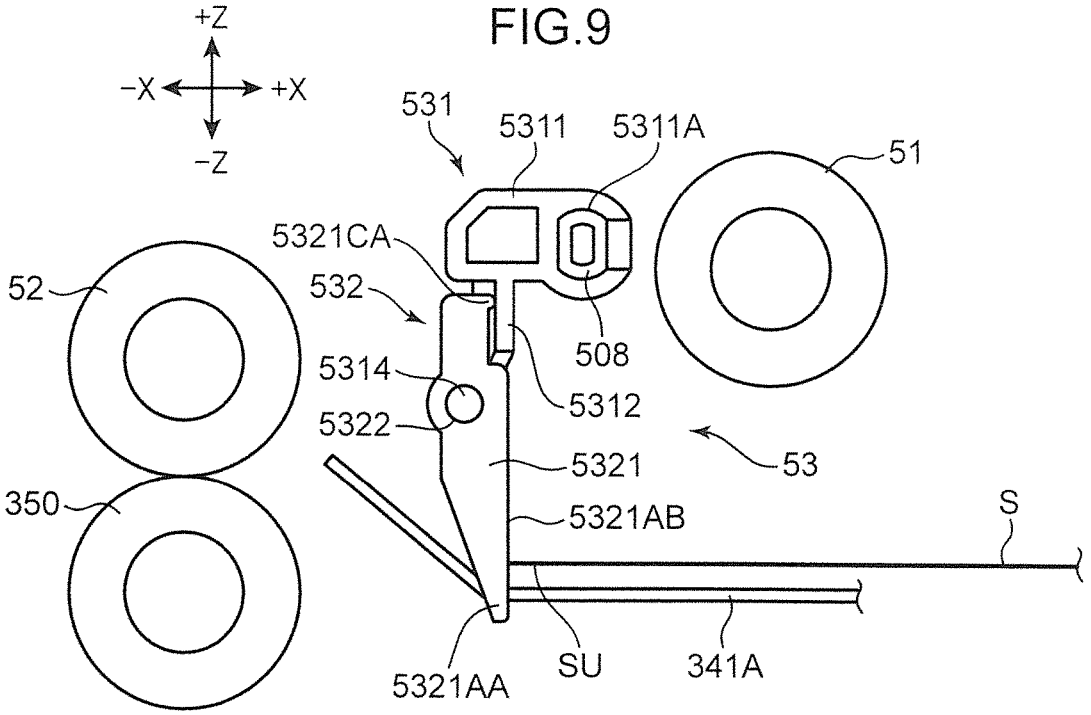
FIG. 9 is a side view schematically showing a stopper mechanism of the document feeding unit, which shows a state where a stopper member of the stopper mechanism is in a first position.
Figure 10:
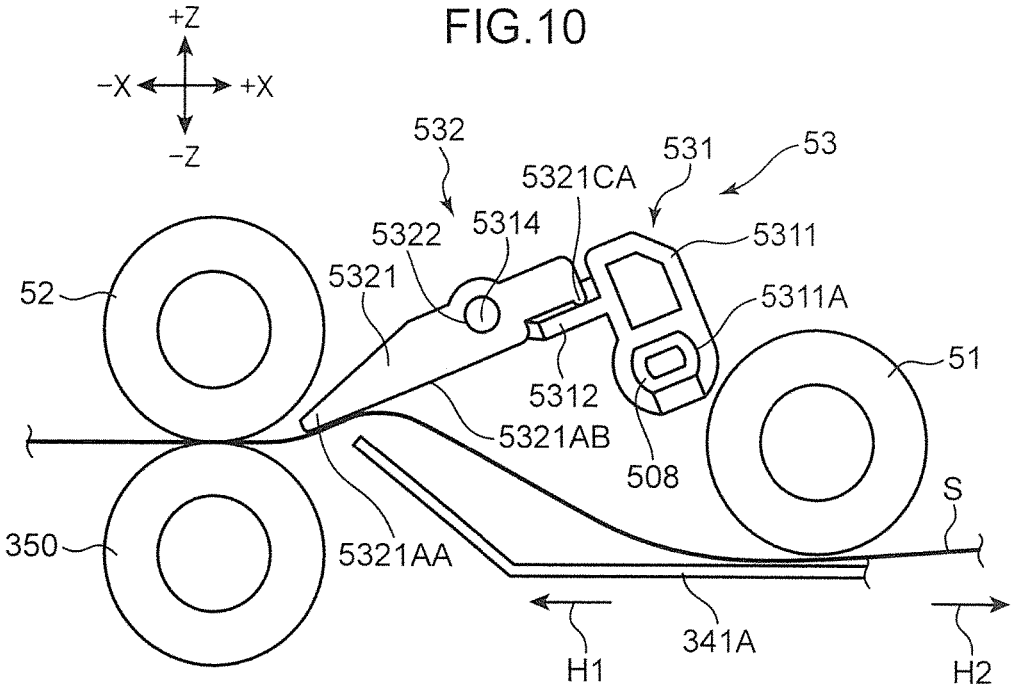
FIG. 10 is a side view showing a state where the stopper member is in a second position.
Figure 11:
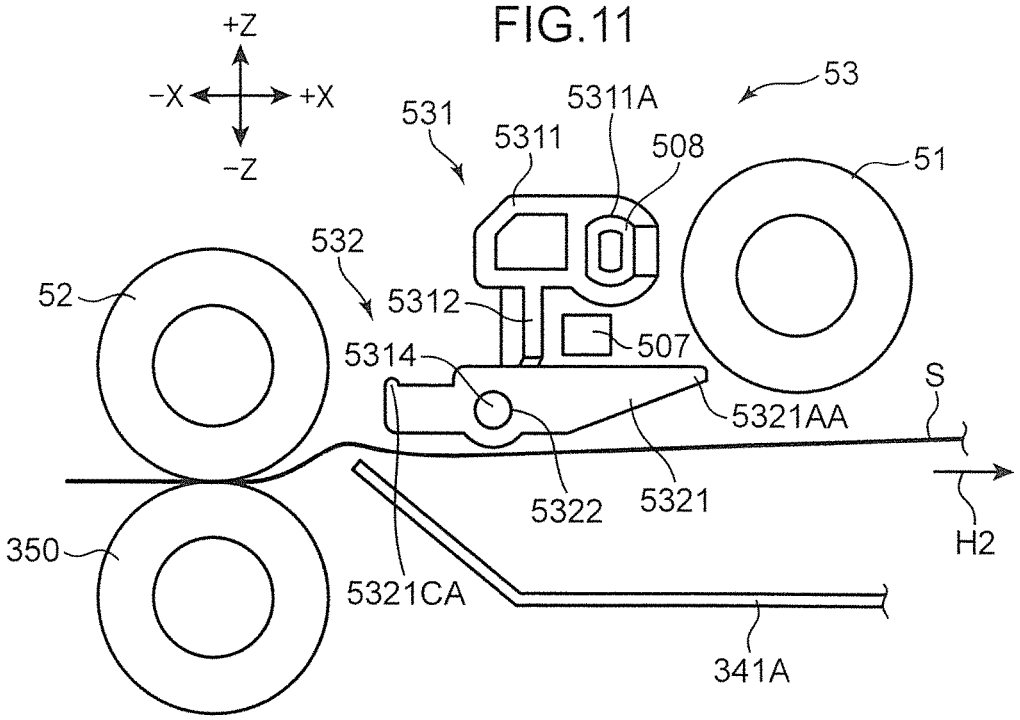
FIG. 11 is a side view showing a state where the stopper member is in a third position.
Figure 12:
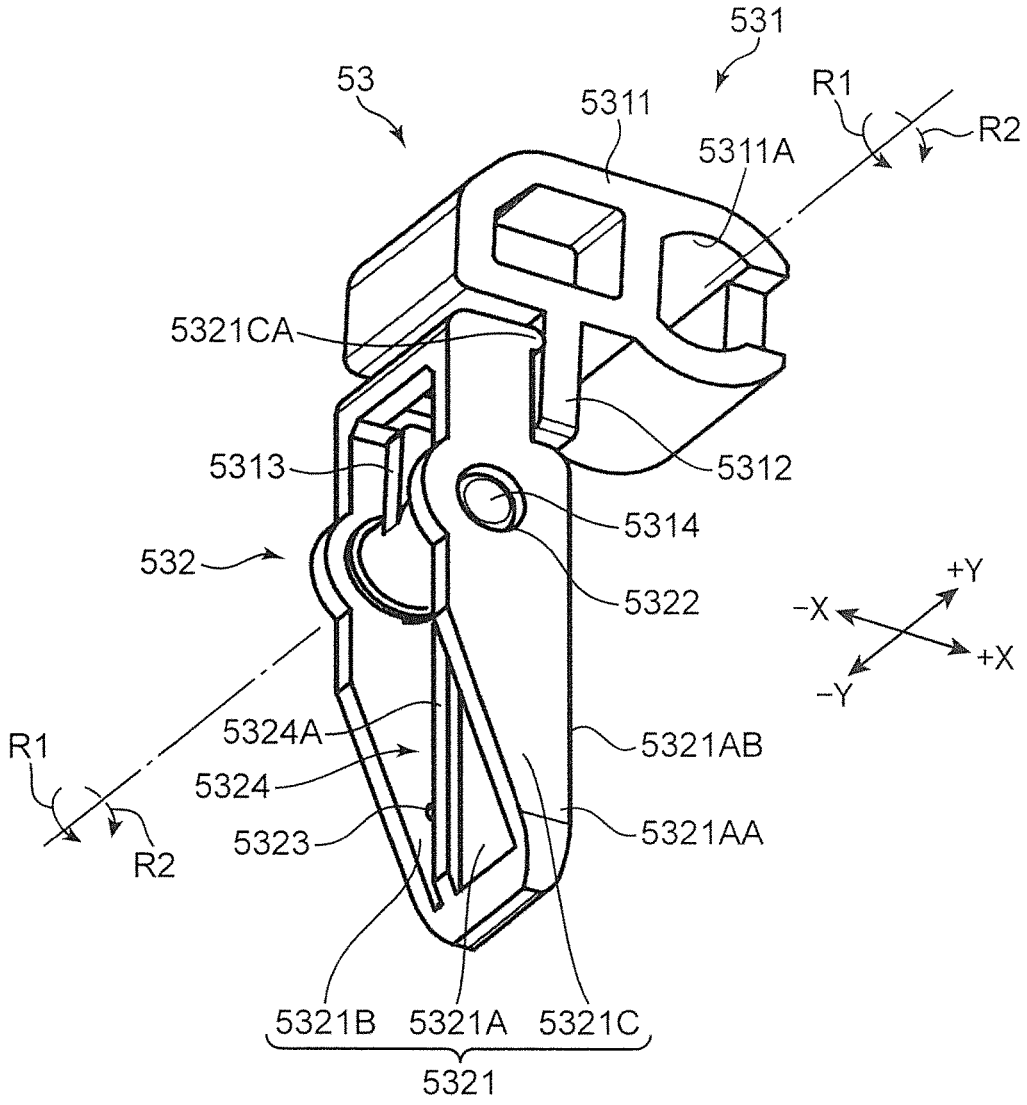
FIG. 12 is a perspective view of the stopper mechanism.
Figure 13:
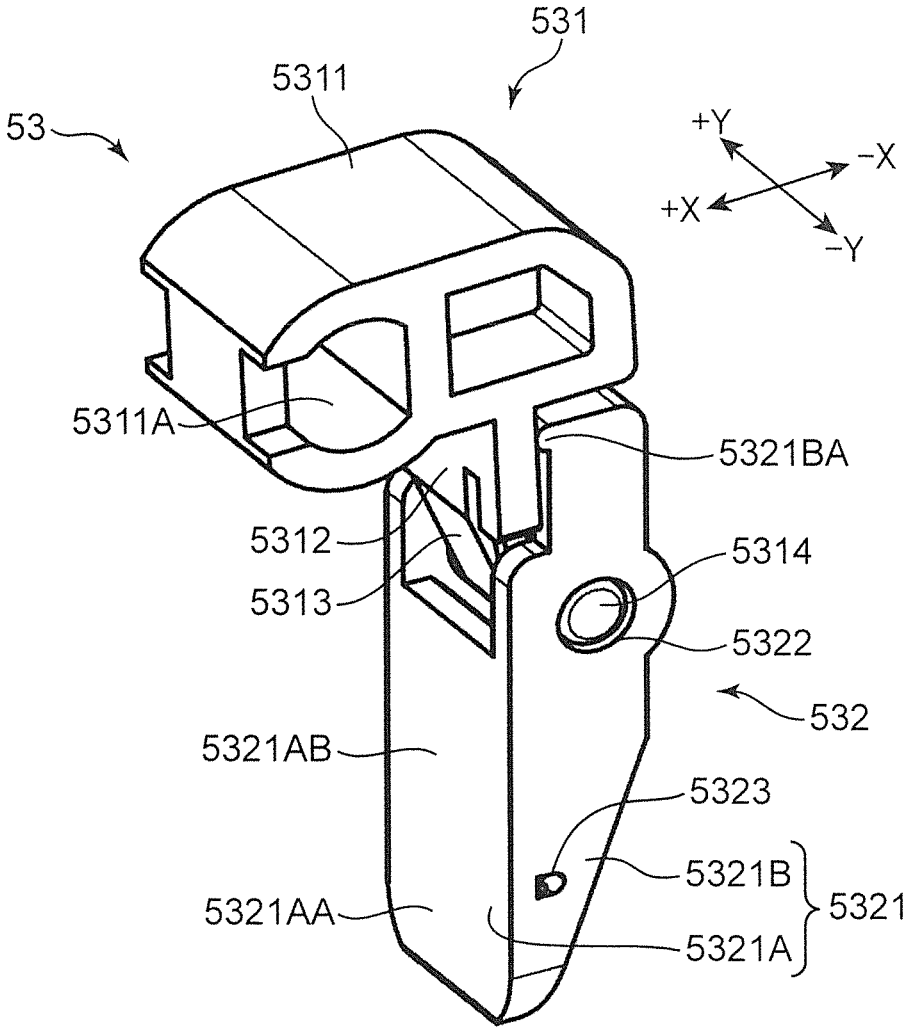
FIG. 13 is a perspective view of the stopper mechanism.
Figure 14:
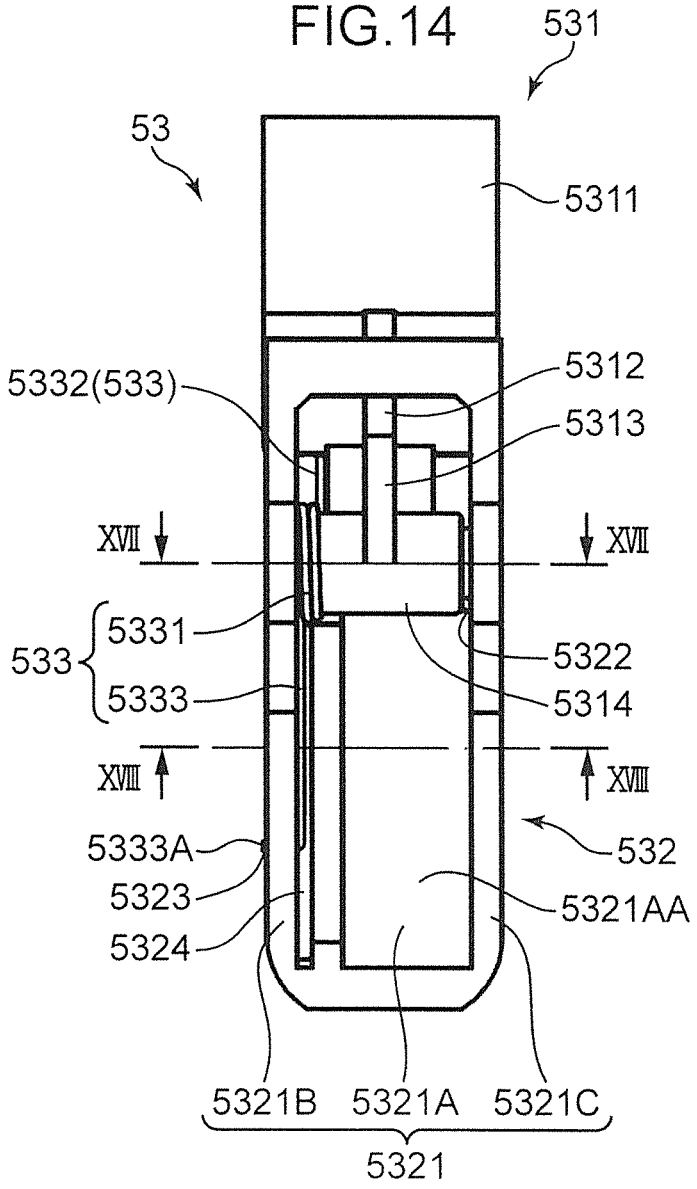
FIG. 14 is a view of the stopper mechanism seen from a front surface side.
Figure 15:
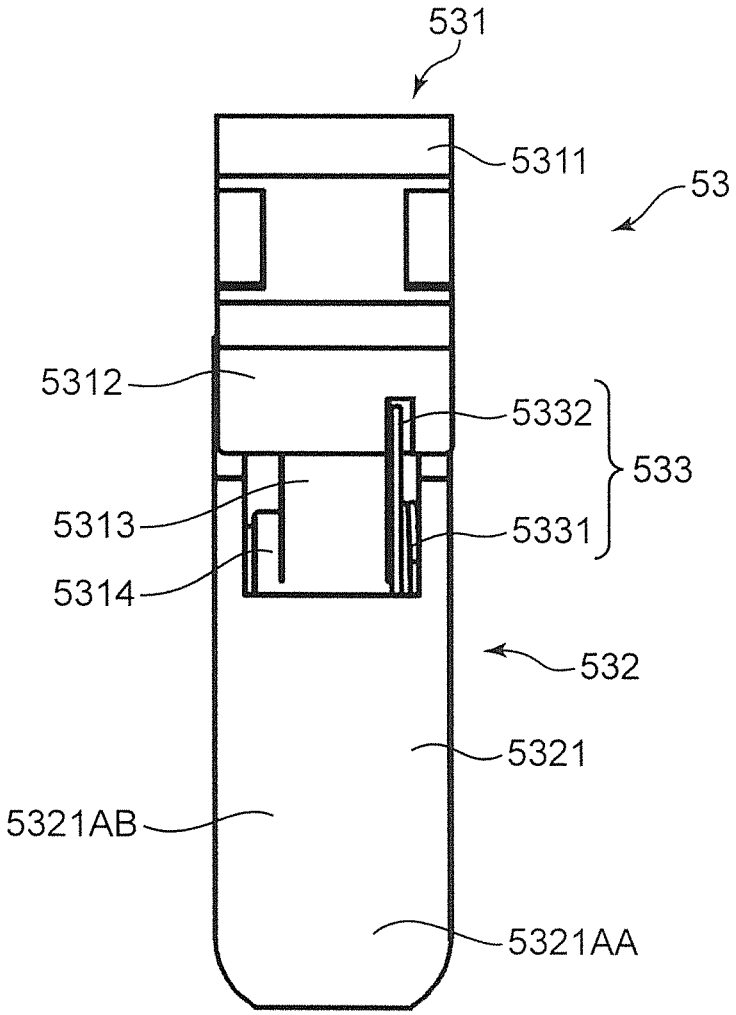
FIG. 15 is a view of the stopper mechanism seen from a back surface side.
Figure 16:
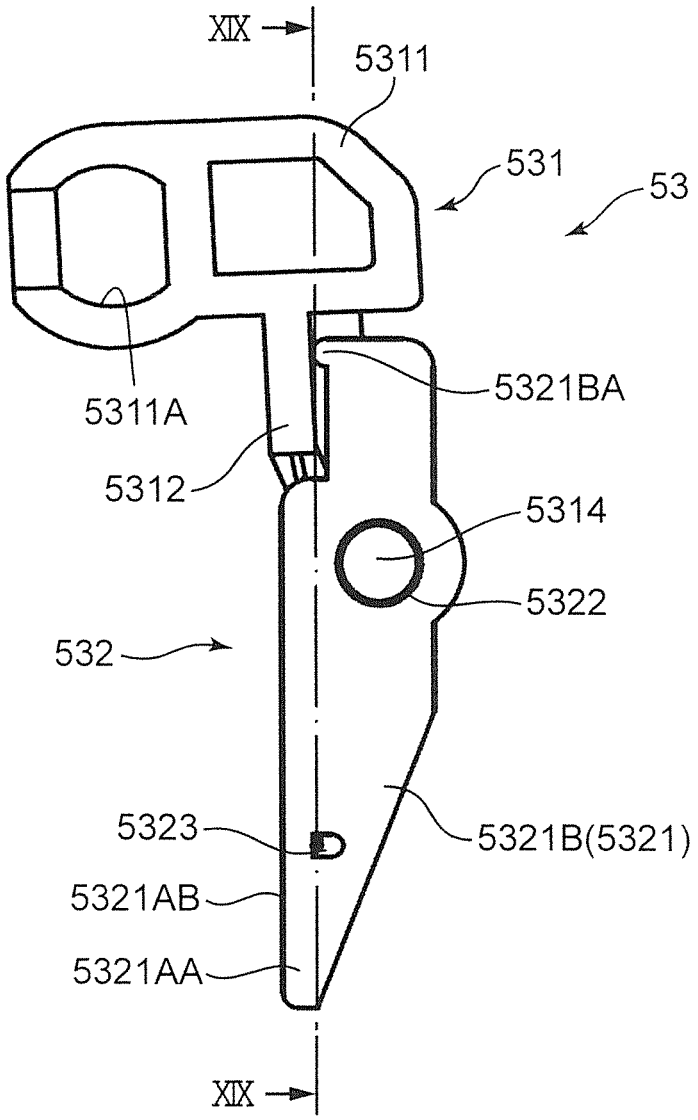
FIG. 16 is a side view of the stopper mechanism.
Figure 17:
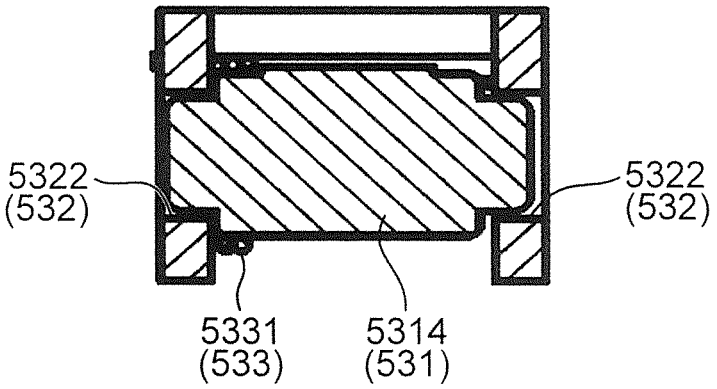
FIG. 17 is a sectional view of the stopper mechanism shown in FIG. 14 seen from a cut surface line XVII-XVII.
Figure 18:
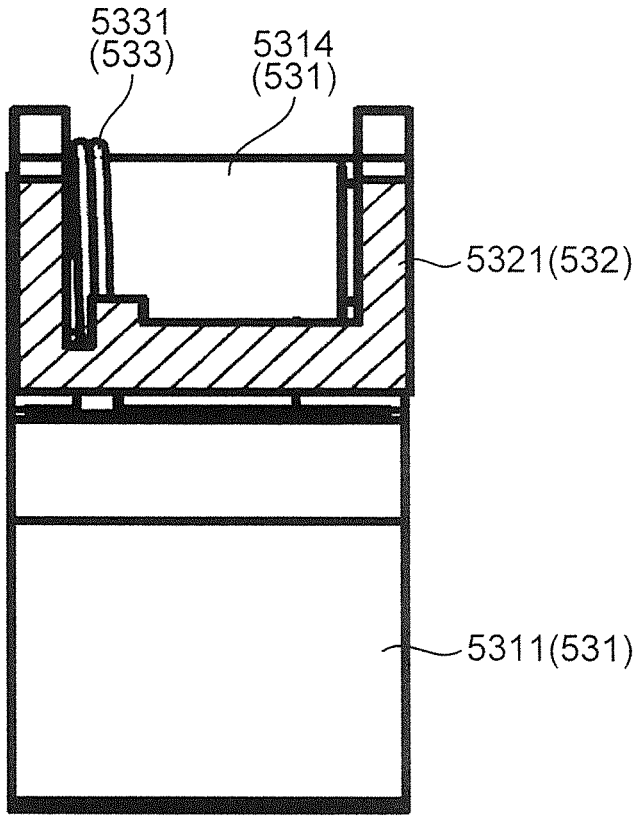
FIG. 18 is a sectional view of the stopper mechanism shown in FIG. 14 seen from a cut surface line XVIII-XVIII.
Figure 19:
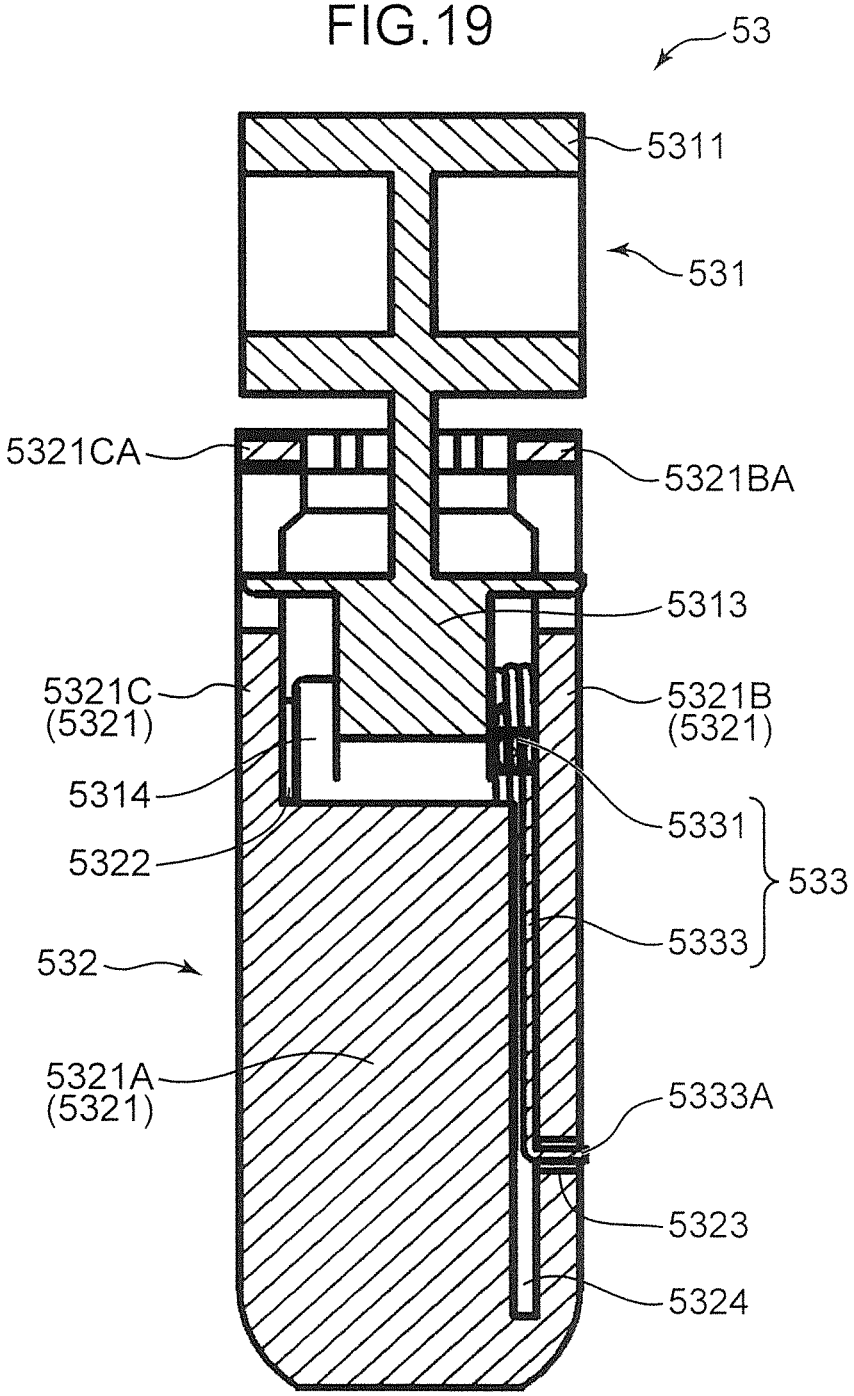
FIG. 19 is a sectional view of the stopper mechanism shown in FIG. 16 seen from a cut surface line XIX-XIX.

As shown in FIG. 8, the stopper mechanism 53 includes a supporting body 531, a stopper member 532, and a biasing member 533. A configuration of the stopper mechanism 53 will be described as follows with reference to FIG. 9 to FIG. 19 in addition to FIG. 8. FIG. 9 to FIG. 11 are side views schematically showing the stopper mechanism 53 of the document feeding unit 5. FIG. 9 showing a state where the stopper member 532 is in a first position, FIG. 10 showing a state where the stopper member 532 is in a second position, and FIG. 11 showing a state where the stopper member 532 is in a third position. FIG. 12 and FIG. 13 are perspective views of the stopper mechanism 53. FIG. 14 shows a view of the stopper mechanism 53 seen from the front surface side, FIG. 15 shows a view seen from the back surface side, and FIG. 16 shows a side view thereof. Additionally, FIG. 17 is a sectional view of the stopper mechanism 53 shown in FIG. 14, seen from a cut surface line XVII-XVII. FIG. 18 is a sectional view seen from a cut surface line XVIII-XVIII. FIG. 19 is a sectional view of the stopper mechanism 53 shown in FIG. 16, seen from a cut surface line XIX-XIX.

The supporting body 531 is supported upstream of the document feeding roller 52 in the first direction H1 in the holder 50. The supporting body 531 has a supporting main body portion 5311, a rotating prevention piece 5312, an extension piece 5313, and a first shaft portion 5314.

The supporting main body portion 5311 has a substantially rectangular shape seen from a direction from the +Y side (the front side) to the −Y side (rear side) and is formed with, at a part on the +X side (the right side), a second turn supporting point 5311A as a through hole extending in the Y direction (front-rear direction). The holder 50 has a second shaft portion 508 provided to protrude from the front plate 501 to the +Y side. The second shaft portion 508 is positioned between the pickup roller 51 and the document feeding roller 52 in the X direction (the right and left direction). In the present embodiment, the supporting body 531 is rotatably supported around the second shaft portion 508 by the holder 50 by insertion of the second shaft portion 508 into the second turn supporting point 5311A. The supporting body 531 is rotatable in a first rotating direction R1 (counterclockwise) around the second shaft portion 508 and in a second rotating direction R2 (clockwise) reverse to the first rotating direction R1.

The rotating prevention piece 5312 is a piece part provided to protrude from a lower surface portion of the supporting main body portion 5311 to the −Z side (lower side) and integrally formed with the supporting main body portion 5311. The rotating prevention piece 5312 contacts the stopper member 532 to be described later to prevent the stopper member 532 from rotating in the second rotating direction R2.

The extension piece 5313 is a piece part continuous with a −Z side end portion of the rotating prevention piece 5312 to stretch to the −Z side. The first shaft portion 5314 is a shaft portion linked to a −Z side end portion of the extension piece 5313 and extending in the Y direction. The stopper member 532 to be described later is rotatably supported by the supporting body 531 via the first shaft portion 5314.

The stopper member 532 has a stopper main body portion 5321 and a first rotation supporting point portion 5322. The stopper main body portion 5321 has a rectangular flat plate-shaped bottom wall portion 5321A, a first side wall portion 5321B vertically arranged at a −Y side edge of the bottom wall portion 5321A, and a second side wall portion 5321C vertically arranged at a +Y side edge of the bottom wall portion 5321A, all of which wall portions being integrally formed.

Each of the first side wall portion 5321B and the second side wall portion 5321C is formed with a coaxial through hole, which serves as the first rotation supporting point portion 5322. The stopper member 532 is rotatably supported around the first shaft portion 5314 by the supporting body 531 by insertion of the first shaft portion 5314 of the supporting body 531 into the first rotation supporting point portion 5322. The stopper member 532 is rotatable in the first rotating direction R1 and the second rotating direction R2 around the first shaft portion 5314.

In the first side wall portion 5321B of the stopper main body portion 5321, at an end portion closer to the supporting body 531 relative to the first rotation supporting point portion 5322, a slightly rising first rising portion 5321BA is formed. Additionally, in the second side wall portion 5321C, at an end portion closer to the supporting body 531 relative to the first rotation supporting point portion 5322, a slightly rising second rising portion 5321CA is formed. In a state where the first rising portion 5321BA and the second rising portion 5321CA are in contact with the rotating prevention piece 5312 of the supporting body 531, rotation of the stopper member 532 in the second rotating direction R2 around the first shaft portion 5314 is regulated.

In the bottom wall portion 5321A of the stopper main body portion 5321, an end portion farther from the supporting body 531 relative to the first rotation supporting point portion 5322 functions as a contact end portion 5321AA. The contact end portion 5321AA is allowed to contact a front end SU of a document sheet S placed on the document feeding tray 31 in the first direction H1. In the contact end portion 5321AA, a back surface reverse to a front surface on which the first side wall portion 5321B and the second side wall portion 5321C are vertically arranged serves as a contact surface 5321AB with which the front end SU of the document sheet S is in contact. In the stopper member 532, contact of the contact end portion 5321AA with the front end SU of the document sheet S regulates feeding of the document sheet S by the document feeding roller 52.

The biasing member 533 is a member which applies an biasing force to the stopper member 532 in the second rotating direction R2 around the first shaft portion 5314. In the present embodiment, the biasing member 533 is configured by a torsion coil spring that includes a coil portion 5331, a first arm portion 5332, and a second arm portion 5333. The coil portion 5331 is inserted into the first shaft portion 5314 of the supporting body 531. The first arm portion 5332 is connected to one end of the coil portion 5331, with a front end portion 5332A fixed to the supporting body 531. The second arm portion 5333 is connected to the other end of the coil portion 5331, with a front end portion 5333A fixed to the stopper member 532.

Further, in the present embodiment, as shown in FIG. 19, the front end portion 5333A of the second arm portion 5333 is bent in the biasing member 533. The stopper member 532 has a hole portion 5323 formed in the first side wall portion 5321B of the stopper main body portion 5321. In the second arm portion 5333, the bent front end portion 5333A is retained in the stopper member 532 while being inserted into the hole portion 5323 of the stopper member 532. This prevents the front end portion 5333A of the second arm portion 5333 from being pulled off, thereby further ensuring fixing of the front end portion 5333A to the stopper member 532.

Additionally, in the present embodiment, as shown in FIG. 12, FIG. 14 and FIG. 19, the stopper member 532 has a groove portion 5324 provided to extend linearly from the first shaft portion 5314 toward the contact end portion 5321AA. The hole portion 5323 is arranged in the groove portion 5324. In the bottom wall portion 5321A of the stopper main body portion 5321, at a −Y side end portion, a protrusion piece 5324A is provided to protrude so as to be opposed to the first side wall portion 5321E and be separated from the first side wall portion 5321B. The groove portion 5324 is defined by the bottom wall portion 5321A, the first side wall portion 5321B, and the protrusion piece 5324A. Then, the second arm portion 5333 is fit in the groove portion 5324. This enables the biasing member 533 to be arranged in a state of being positioned with respect to the stopper member 532.

In thus configured stopper mechanism 53, the stopper member 532 is allowed to change a position among the first position (the position shown in FIG. 9), the second position (the position shown in FIG. 10), and the third position (the position shown in FIG. 11).

The first position is a position in which the contact end portion 5321AA contacts the front end SU of the document sheet S to regulate feeding of the document sheet S by the document feeding roller 52. The stopper member 532, as shown in FIG. 9, assumes the first position when, due to a swinging operation of the holder 50, the pickup roller 51 is separated from the document sheet S to be arranged in the retreat position. When the stopper member 532 assumes the first position, the first rising portion 5321BA and the second rising portion 5321CA are in contact with the rotating prevention piece 5312 of the supporting body 531, so that rotation of the stopper member 532 in the second rotating direction R2 around the first shaft portion 5314 is regulated.

In the first position, the stopper member 532 protrudes toward a downstream end of the document feeding tray 31, so that the contact surface 5321AB of the contact end portion 5321AA becomes a wall surface extending substantially vertically to the document sheet S placed on the document feeding tray 31. This allows the contact surface 5321AB of the contact end portion 5321AA to contact the front end SU of the document sheet S. Thus, in the first position, the stopper member 532 contacts the front end SU of the document sheet S to absorb flexure of the document sheet S to enable the front end SU of the document sheet S to be aligned. As a result, sending of the document sheet S in an oblique posture by the pickup roller 51 can be prevented.

The first position of the stopper member 532 is maintained by a first contact piece 322 (see FIG. 4). The first contact piece 322 is formed on the top 320 of the cover body 32U. When the pickup roller 51 is arranged in the retreat position, the holder 50 abuts on the top 320. The position of the first contact piece 322 is set such that the first contact piece 322 can contact the supporting main body portion 5311 of the supporting body 531 in a state where the holder 50 abuts on the top 320.

With the stopper member 532 being in the first position, when a user puts the document sheet S on the document feeding tray 31 to abut onto the front end SU against the contact end portion 5321AA of the stopper member 532, a pressing force of the document sheet S acts on the contact end portion 5321AA. The pressing force of the document sheet S tries to rotate the stopper member 532 and thus the supporting body 531 in the second rotating direction R2. However, since at this time, the first contact piece 322 contacts the supporting main body portion 5311 of the supporting body 531, rotation of the supporting body 531 in the second rotating direction R2 is prevented. As a result, the first position of the stopper member 532 is maintained.

Additionally, when the stopper member 532 assumes the first position, a rotating operation of the stopper member 532 around the first shaft portion 5314 is regulated. In other words, since when the stopper member 532 assumes the first position, the first rising portion 5321BA and the second rising portion 5321CA are in contact with the rotating prevention piece 5312 of the supporting body 531 as described above, rotation of the stopper member 532 in the second rotating direction R2 around the first shaft portion 5314 is regulated. On the other hand, since the biasing member 533 applies, to the stopper member 532, a biasing force in the second rotating direction R2 around the first shaft portion 5314, rotation of the stopper member 532 in the first rotating direction R1 around the first shaft portion 5314 is regulated.

This suppresses the stopper member 532 in contact with the front end SU of the document sheet S in the first position from swinging to assume the third position, which is to be described later, before the feeding operation of the document sheet S by the document feeding roller 52. Therefore, the function of the stopper member 532, that is, the function of contacting the front end SU of the document sheet S to absorb flexure of the document sheet S before the feeding operation by the document feeding roller 52, and aligning the front end SU of the document sheet S are not damaged. It is accordingly possible to appropriately align the front end SU of the document sheet S by the stopper member 532 before the feeding operation by the document feeding roller 52.

The second position is a position in which the contact end portion 5321AA is separated from the front end SU of the document sheet S to face the first direction H1, thereby allowing feeding of the document sheet S by the document feeding roller 52. As shown in FIG. 10, the stopper member 532 assumes the second position when the pickup roller 51 is arranged at the paper feeding position to contact the document sheet S due to the swinging operation of the holder 50. When the stopper member 532 is in the second position, the first rising portion 5321BA and the second rising portion 5321CA are in contact with the rotating prevention piece 5312 of the supporting body 531, so that rotation of the stopper member 532 in the second rotating direction R2 around the first shaft portion 5314 is regulated.

When the holder 50 swings such that the pickup roller 51 is arranged at the paper feeding position, i.e., when a +X side end portion of the holder 50 lowers, the supporting main body portion 5311 of the supporting body 531 is separated from the first contact piece 322 of the top 320. This brings a state where rotation of the supporting body 531 in the second rotating direction R2 around the second shaft portion 508 is allowed. Then, when sending of the document sheet S is started by the rotation operation of the pickup roller 51, a pressing force caused by sending of the document sheet S acts on the contact end portion 5321AA of the stopper member 532.

The pressing force of the document sheet S to the contact end portion 5321AA becomes a force to rotate the supporting body 531 in the second rotating direction R2 around the second shaft portion 508 via the stopper member 532. As a result, the supporting body 531 rotates in the second rotating direction R2 around the second shaft portion 508, and along with the rotation of the supporting body 531, the contact end portion 5321AA of the stopper member 532 is separated from the front end SU of the document sheet S to assume the second position. At this time, the contact end portion 5321AA faces to the first direction H1 to such an extent as not to hinder sending of the document sheet S to the document feeding roller 52 by the pickup roller 51. When the document sheet S is sent out by the pickup roller 51, the contact end portion 5321AA is positioned on the first transportation path 341, so that the document sheet S is transported while sliding relative to the contact end portion 5321AA.

On the front plate 501 of the holder 50, a second contact piece 506 (see FIG. 6) is formed. The position of the second contact piece 506 on the front plate 501 is set in the vicinity of the supporting body 531 and closer to the pickup roller 51 than to the supporting body 531 in the X direction. Additionally, the second contact piece 506 extends in the Z direction of the front plate 501. A height of the second contact piece 506 in the Z direction is set such that with the stopper member 532 being in the second position, when the supporting body 531 rotates in the second rotating direction R2 around the second shaft portion 508 to an extent exceeding a predetermined range of rotation, an upper edge of the second contact piece 506 is allowed to contact the supporting main body portion 5311 of the supporting body 531.

Accordingly, the pressing force caused by sending of the document sheet S acts on the contact end portion 5321AA of the stopper member 532, so that when the pressing force causes the supporting body 531 to try to rotate in the second rotating direction R2 around the second shaft portion 508 to an extent exceeding a predetermined range of rotation, the second contact piece 506 is brought into contact with the supporting main body portion 5311. As a result, the supporting body 531 is prevented from rotating more than necessary, and thus the second position of the stopper member 532 is stabilized.

Additionally, when the stopper member 532 is in the second position, the rotating operation of the stopper member 532 around the first shaft portion 5314 is regulated. In other words, when the stopper member 532 is in the second position, as described above, the first rising portion 5321BA and the second rising portion 5321CA are in contact with the rotating prevention piece 5312 of the supporting body 531, so that rotation of the stopper member 532 in the second rotating direction R2 around the first shaft portion 5314 is regulated. On the other hand, since the biasing member 533 applies, to the stopper member 532, an biasing force in the second rotating direction R2 around the first shaft portion 5314, rotation of the stopper member 532 in the first rotating direction R1 around the first shaft portion 5314 is regulated.

As a result, during the feeding operation, by the document feeding roller 52, of the document sheet S sent by the pickup roller 51, rotation of the stopper member 532 in the second position to the third position to be described later is regulated, the third position being attained by rotation in the first rotating direction R1 from the second position. Therefore, even when vibration or the like occurs in the Z direction during the feeding operation of the document sheet S by the document feeding roller 52, interference of the stopper member 532 with the guide wall portion 341A or the like is suppressed, the guide wall portion 341A defining a lower surface portion of a most upstream end portion of the first transportation path 341. Accordingly, during the feeding operation by the document feeding roller 52, favorable performance of transportation of a document sheet S can be maintained.

The third position is a position rotated in the first rotating direction R1 around the first shaft portion 5314 from the second position such that the contact end portion 5321AA faces to a second direction H2 reverse to the first direction H1. The stopper member 532 is allowed to assume the third position when with the stopper member 532 being in the second position, the jam of the document sheet S occurs in the document feeding unit 5.

In the document sheet transportation device 3 of the present embodiment, when the jam of the document sheet S occurs, the jammed document sheet S can be removed by opening the cover body 32U to externally expose the first transportation path 341 and the second transportation path 342.

However, when a part of the jammed document sheet S is left on the document feeding tray 31, the document sheet S might be drawn out by a user in the second direction H2. Such drawing-out of the document sheet S forced by the user might cause the document sheet S to be caught by the stopper member 532 being in the second position, resulting in damaging the document sheet S.

Position change of the stopper member 532 from the second position to the third position in the present embodiment solves the above problem. Specifically, as shown in FIG. 10, in a state where the pickup roller 51 is arranged at the paper feeding position and the stopper member 532 is in the second position, when the jam of the document sheet S occurs, the user grasps a part of the document sheet S which remains outside the pickup roller 51 to draw out the same in the second direction H2. The pickup roller 51 receives a force acting upward from the document sheet S as a result of a drawing-out operation of the document sheet S in the second direction H2. When the force is transmitted to the holder 50 via the pickup roller 51, the holder 50 swings to cause the pickup roller 51 to start moving upward. In other words, the pickup roller 51 starts moving from the paper feeding position to the retreat position.

At this time, since the contact end portion 5321AA of the stopper member 532 in contact with the jammed document sheet S faces to the first direction H1, the drawing-out operation of the document sheet S in the second direction H2 causes a tensile force of moving the contact end portion 5321AA in the second direction H2 to act on the contact end portion 5321AA. The tensile force causes a force to act on the stopper member 532 to rotate in the first rotating direction R1 around the first shaft portion 5314. As a result, the stopper member 532 rotates in the first rotating direction R1 around the first shaft portion 5314 to assume the third position. This suppresses the document sheet S drawn out from the document feeding unit 5 from being caught by the stopper member 532. Therefore, damage of the document sheet S drawn out from the document feeding unit 5 is suppressed.

Here, the supporting body 531 supporting the stopper member 532 rotates in the first rotating direction R1 around the second shaft portion 508 in conjunction with position change of the stopper member 532 from the second position to the third position. Specifically, when a tensile force acts on the contact end portion 5321AA of the stopper member 532, the tensile force is transmitted to the supporting body 531 via the stopper member 532. When the tensile force is transmitted to the supporting body 531, the supporting body 531 rotates in the first rotating direction R1 around the second shaft portion 508. A pressure of the document sheet S drawn out by the rotation of the supporting body 531 in the first rotating direction R1 is relieved by the stopper member 532 and the supporting body 531 in this order. This leads to smooth position change of the stopper member 532 to the third position.

The third position of the stopper member 532 is maintained by a third contact piece 507 (see FIG. 6 and FIG. 11). The third contact piece 507 is formed at a position immediately below the supporting main body portion 5311 in the supporting body 531, and at a position immediately right of the rotating prevention piece 5312. In other words, the third contact piece 507 is formed at a position which enables the first rising portion 5321BA and the second rising portion 5321CA to contact the rotating prevention piece 5312 when the stopper member 532 is in the first position. When the supporting body 531 rotates in the first rotating direction R1 around the second shaft portion 508 along with position change of the stopper member 532 to the third position, the third contact piece 507 is brought into contact with the rotating prevention piece 5312. This prevents the supporting body 531 from rotating, so that the third position of the stopper member 532 is maintained.

After the jammed document sheet S is drawn out, the stopper member 532 in the third position rotates in the second rotating direction R2 around the first shaft portion 5314 by an biasing force of the biasing member 533 to assume the first position until the first rising portion 5321BA and the second rising portion 5321CA contact the rotating prevention piece 5312 of the supporting body 531.

As described in the foregoing, the image forming apparatus 1 according to the present embodiment is provided with the document sheet transportation device 3 capable of suppressing damage of a document sheet S while maintaining favorable performance of transportation of the document sheet S. It is therefore possible to smoothly conduct an image forming operation according to a document image of the document sheet S.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A document sheet transportation device comprising:

a document sheet placement portion on which a document sheet is placed;

a document sheet transportation path provided to extend from the document sheet placement portion to form a transportation path of the document sheet; and a feeding portion which feeds the document sheet toward the document sheet transportation path, wherein the feeding portion includes:

a holder;

a feeding member rotatably supported by the holder to feed the document sheet along a first direction;

a supporting body which has a first shaft portion and is supported, in the holder, at an upstream side of the feeding member in the first direction;

a stopper member which has a contact end portion allowed to contact a front end of the document sheet in the first direction, the document sheet being placed on the document sheet placement portion, the stopper member being rotatably supported around the first shaft portion by the supporting body, and which regulates feeding of the document sheet by the feeding member by contact of the contact end portion with the front end of the document sheet; and a biasing member which applies a biasing force around the first shaft portion to the stopper member, the stopper member is allowed to change a position among a first position, a second position, and a third position, the first position being a position in which the contact end portion contacts the front end of the document sheet, the second position being a position in which the contact end portion is separated from the front end of the document sheet and is disposed downstream of the first position in the first direction, thereby allowing feeding of the document sheet by the feeding member, and the third position being a position in which the contact end portion rotates, from the second position, in a first rotating direction around the first shaft portion and is disposed upstream of the first position, and the biasing member applies the biasing force to the stopper member in a second rotating direction reverse to the first rotating direction around the first shaft portion, wherein the biasing member is a torsion coil spring, the torsion coil spring including:

a coil portion sheathed around the first shaft portion;

a first arm portion connected to one end of the coil portion and having a front end portion fixed to the supporting body; and a second arm portion connected to another end of the coil portion and having a front end portion fixed to the stopper member, and wherein the stopper member has a hole portion, and the front end portion of the second arm portion is bent, and with the bent front end portion being inserted into the hole portion, the torsion coil spring is retained in the stopper member.

2. The document sheet transportation device according to claim 1, wherein the stopper member has a groove portion provided to extend linearly from the first shaft portion toward the contact end portion, the hole portion being arranged in the groove portion, and the second arm portion is fit in the groove portion.

3. The document sheet transportation device according to claim 1, wherein the holder has a second shaft portion, and the supporting body is rotatably supported around the second shaft portion by the holder, and rotates in the second rotating direction (R2) around the second shaft portion in conjunction with position change of the stopper member from the first position to the second position, while rotating in the first rotating direction around the second shaft portion in conjunction with position change of the stopper member from the second position to the third position.

4. An image forming apparatus comprising:

the document sheet transportation device according to claim 1;

a document reading portion which reads a document image of a document sheet transported by the document sheet transportation device to output image data according to the document image; and an image forming portion which forms an image based on the image data on a sheet.

* * * * *